US008403325B2

(12) United States Patent
Moriyama et al.

(10) Patent No.: US 8,403,325 B2
(45) Date of Patent: Mar. 26, 2013

(54) IMAGE FORMING APPARATUS INCLUDING SHEET STACKING APPARATUS

(75) Inventors: Tsuyoshi Moriyama, Toride (JP); Hitoshi Kato, Toride (JP); Yasuo Fukatsu, Abiko (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 254 days.

(21) Appl. No.: 12/115,491

(22) Filed: May 5, 2008

(65) Prior Publication Data

US 2008/0277866 A1 Nov. 13, 2008

(30) Foreign Application Priority Data

May 7, 2007 (JP) ..... 2007-122533

(51) Int. Cl.
*B65H 39/10* (2006.01)

(52) U.S. Cl. ..... 271/288; 271/279; 271/287; 271/290

(58) Field of Classification Search ..... 271/288, 271/279, 287, 290
See application file for complete search history.

(56) References Cited

U.S. PATENT DOCUMENTS

| | | | | |
|---|---|---|---|---|
| 5,106,076 | A * | 4/1992 | Fujita et al. | 271/287 |
| 5,735,202 | A * | 4/1998 | Sakakibara et al. | 101/2 |
| 6,293,714 | B2 * | 9/2001 | Noda | 400/61 |
| 6,481,711 | B1 * | 11/2002 | Pickett | 271/298 |
| 7,201,372 | B2 * | 4/2007 | Kapturowski et al. | 271/298 |

FOREIGN PATENT DOCUMENTS

| | | |
|---|---|---|
| JP | 2002-044304 A | 2/2002 |
| JP | 2006124052 A | 5/2006 |

* cited by examiner

*Primary Examiner* — Michael McCullough
*Assistant Examiner* — Howard Sanders
(74) *Attorney, Agent, or Firm* — Canon USA, Inc., IP Division

(57) ABSTRACT

An image forming apparatus for printing multiple copies of a document, the document having N (where N is an integer) pages, includes an image forming unit configured to print images on a plurality of sheets according to an input print job, a sheet stacking unit configured to stack sheets printed by the image forming unit, and a control unit configured to divide a print job which prints M (where M is an integer) copies of each of the N pages of the document into a plurality of print operations in a case where a group mode in which sheets are stacked into N groups, each group having M copies of a respective page of the document, is set in the print job, wherein each of the plurality of print operations is for printing less than M copies of each of the N pages of the document.

10 Claims, 22 Drawing Sheets

IMAGE FORMING APPARATUS INCLUDING SHEET STACKING APPARATUS

BACKGROUND OF THE INVENTION

1. Field of the Invention

The present invention relates to a stacking control system for stacking sheets that are discharged from an image forming apparatus to a plurality of sheet stacking units.

2. Description of the Related Art

In recent years, image forming apparatuses that form an image on a sheet and that discharge a large number of sheets at high speed have been developed. Consequently, there is a demand that a sheet stacking apparatus which receives and stacks the sheets discharged from the image forming apparatus main body is capable of stacking a large number of sheets while maintaining stacking alignment of the sheets. Japanese Patent Application Laid-Open No. 2006-124052 discusses a sheet stacking apparatus (hereinafter referred to as a "stacker apparatus") which responds to such a requirement.

FIG. 22 illustrates a cross-sectional view of such a conventional stacker apparatus 500.

In stacker apparatus 500, an inlet roller 501 receives a sheet which is discharged from the image forming apparatus main body. A conveyance roller pair 502 then delivers the sheet to a gripper 503. The gripper 503 grips and conveys the sheet, so that a leading edge of the sheet abuts on a leading edge stopper 504. When the sheet abuts on the leading edge stopper 504, the gripper 503 releases the sheet to fall onto a sheet stacking tray 505. At this time, the sheet falls between the leading edge stopper 504 and a trailing edge stopper 508, so that the leading edge and the trailing edge of the sheet are aligned. Further, a side edge of the sheet which is perpendicular to a sheet conveyance direction is aligned by a width alignment mechanism (not illustrated) as necessary.

In the above-described conventional stacker apparatus, if a number of sheets that are stacked on the sheet stacking tray 505 reaches the maximum stacking capacity, or a print job ends before reaching the maximum stacking capacity, the sheets that are stacked on the sheet stacking tray 505 become ready for removal.

Conventionally, in a case where a user wants to increase the stacking capacity, the user may use a plurality of stacker apparatuses that are connected to each other.

FIG. 23 illustrates two stacker apparatuses 500*a* and 500*b* connected to each other.

For example, it is assumed that the maximum stacking capacity of each stacker apparatus is 5000 sheets respectively in a case where a user connects and uses a plurality of stacker apparatuses 500*a* and 500*b* as illustrated in FIG. 23. Further, suppose that a user inputs a print job that prints 1000 copies of a booklet of 10 pages in a group mode. In the group mode, as a print job, M (where M is an integer) copies of each of one to N (where N is an integer) pages of images are printed, and N groups with M sheets respectively are stacked. In a case where a user prints 1000 copies of original images consisting of page one to ten, a stack of 1000 copies of a page on which the same original image is printed is created, and the batches of the 1000 copies are stacked in the order of pages. In such a case, a set number of sheets of each original page of the images is continuously printed, and the process is repeated for each of the pages.

When an image forming apparatus executes the above-described print job, 1000 copies of each of the first through fifth pages of the document are sequentially stacked on a stacker apparatus 505*b*. As a result, the number of stacked sheets reaches the maximum stacking capacity, i.e., 5000 sheets. Therefore, 1000 copies of each of the sixth to tenth pages of the document are then sequentially stacked on a stacker apparatus 505*a*.

At this point, a user may start compiling booklets whose original consists of ten pages; however, the user cannot create the booklets. Even if the user takes out the sheet stacks that are fully stacked on the stacker apparatus 505*b* to the outside, sheets of sixth through tenth page of the document are still being stacked on the stacker apparatus 505*a*. Therefore, the user needs to wait until stacking of the sheets of sixth through tenth page is finished in the stacker apparatus 505*a*, which lowers the productivity.

SUMMARY OF THE INVENTION

The present invention is directed to an image forming apparatus and a method of controlling sheet stacking that allows a user to promptly start a bookbinding processing when a plurality of copies of the same page is continuously printed.

According to an aspect of the present invention, an image forming apparatus for printing multiple copies of a document, the document having N (where N is an integer) pages, includes an image forming unit configured to print images on a plurality of sheets according to an input print job, a sheet stacking unit configured to stack sheets printed by the image forming unit, and a control unit configured to divide a print job which prints M (where M is an integer) copies of each of the N pages of the document into a plurality of print operations in a case where a group mode in which sheets are stacked into N groups, each group having M copies of a respective page of the document, is set in the print job, wherein each of the plurality of print operations is for printing less than M copies of each of the N pages of the document.

Further features and aspects of the present invention will be apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the present invention and, together with the description, serve to explain the principles of the present invention.

DETAILED DESCRIPTION OF THE EMBODIMENTS

Various exemplary embodiments, features, and aspects of the invention are described in detail below with reference to the drawings.

Figure 1:
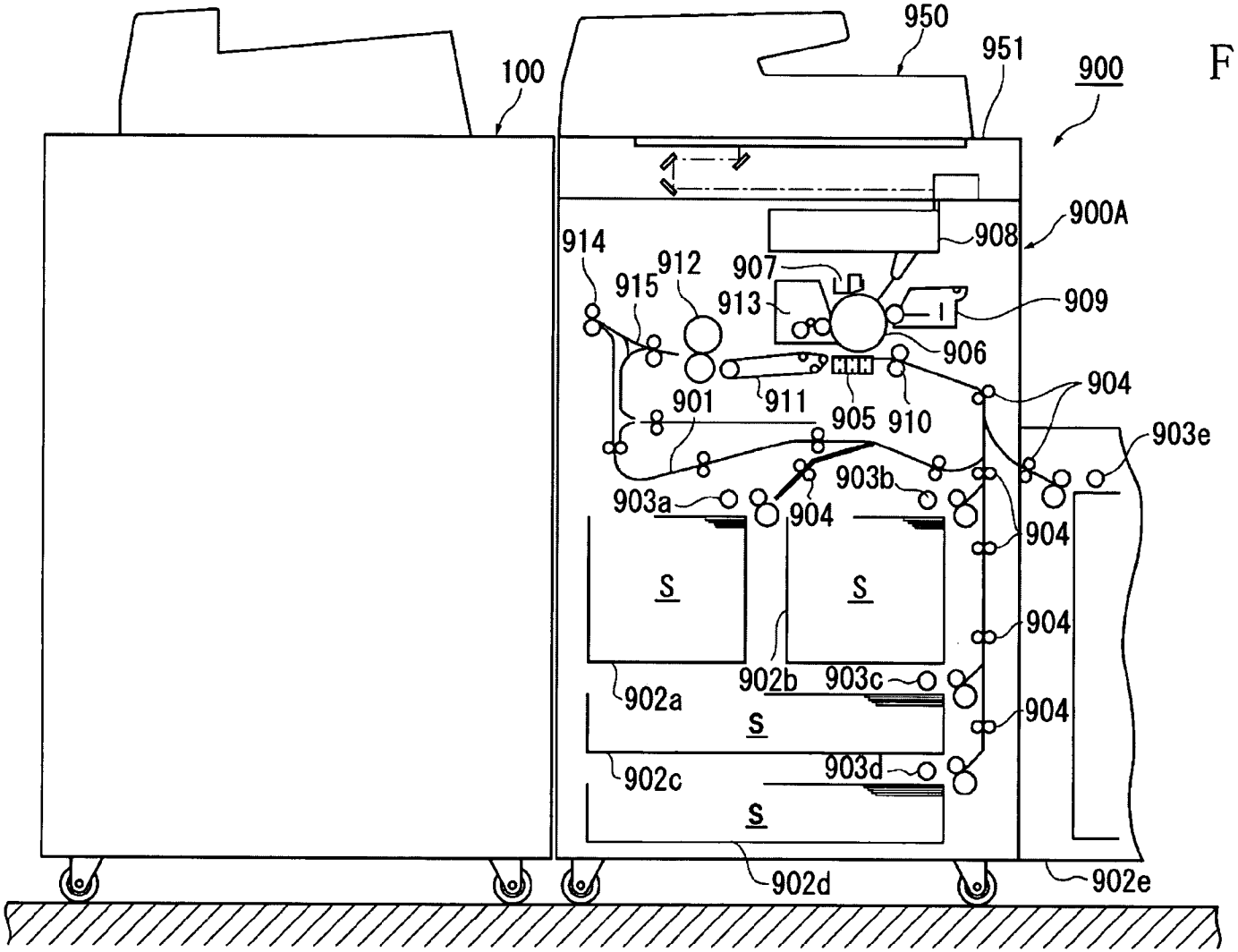
FIG. 1 illustrates a cross-sectional view of an example of an image forming apparatus according to an exemplary embodiment of the present invention.

FIG. 1 illustrates a cross-sectional view of an image forming apparatus according to an exemplary embodiment of the present invention. The cross-sectional view is illustrated along a sheet conveying direction of the image forming apparatus. The sheet can be made of paper for example. Stacked sheets may be indicated by S at various locations in the figures.

In an image forming apparatus 900, an apparatus main body (i.e., image forming unit) 900A includes a sheet stacking apparatus (hereinafter referred to as "stacker apparatus") 100. The stacker apparatus 100 is connected to the apparatus main body 900A as an optional apparatus. However, the stacker apparatus 100 can be integrated inside the apparatus main body 900A.

The apparatus main body 900A includes an image reader 951 and an automatic document feeder 950 in the upper portion. A sheet "S" which is set in any of sheet cassettes 902*a*, 902*b*, 902*c*, 902*d*, and 902*e* is conveyed to a registration roller pair 910 by feeding rollers 903*a*, 903*b*, 903*c*, 903*d*, and 903*e* and a plurality of conveyance roller pairs 904.

A photosensitive drum 906 which is charged by a primary charging device 907 is exposed by an exposure unit 908, and image data of a document which is read by the image reader 951 is formed into an electrostatic latent image on the photosensitive drum 906. A development device 909 then develops the electrostatic latent image formed on the photosensitive drum 906 as a toner image.

The registration roller pair 910 conveys the sheet which enters between the photosensitive drum 906 and a transfer unit 905 aligning with a position of the toner image. The transfer unit 905 transfers the toner image from the photosensitive drum 906 onto the sheet. Foreign matter such as residual toner which is not transferred to the sheet and remaining on the photosensitive drum 906 is cleaned off by a blade of a cleaning device 913. As a result, the surface of the photosensitive drum 906 is cleaned in preparation for the next image forming.

A conveyance belt 911 conveys the sheet on which the toner image is formed to the fixing device 912. The sheet is then pinched between a heating roller and a pressure roller of the fixing device 912 to be heat-pressed, and the toner image is fixed on the sheet. The sheet on which the toner image is fixed is directly conveyed to the stacker apparatus 100 by a discharge roller pair 914. Otherwise, the sheet is conveyed to a two-sided-reversing device 901 by a flapper 915 so that a toner image is again formed on the reverse side of the sheet.

Figure 2:
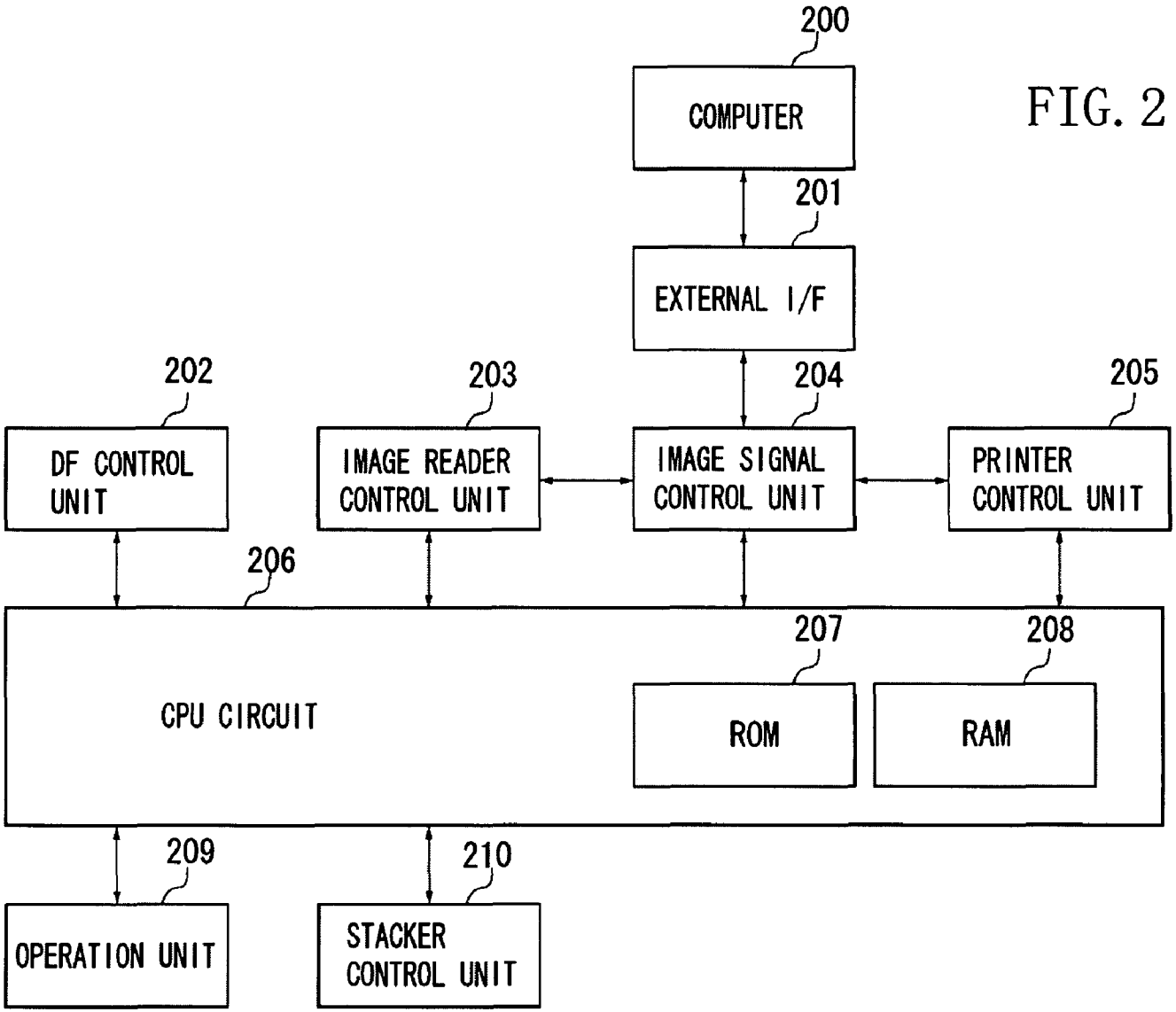
FIG. 2 is an example of a block diagram illustrating a control device which controls a process performed by an image forming apparatus according to an exemplary embodiment of the present invention.

FIG. 2 is a block diagram illustrating a control device which controls an operation of the image forming apparatus 900.

Referring to FIG. 2, a central processing unit (CPU) circuit 206 includes a CPU (not illustrated), a read-only memory (ROM) 207, and a random access memory (RAM) 208. The CPU circuit 206 performs overall control of the blocks 201, 202, 203, 204, 205, 209, and 210 illustrated in FIG. 2 by executing a control program stored in the ROM 207. The RAM 208 temporarily stores control data and is used as a work area for conducting calculations associated with control performed by the CPU circuit 206.

A document feeding (DF) control unit 202 controls driving of the automatic document feeder 950 according to an instruction from the CPU circuit 206. An image reader control unit 203 controls driving of a scanner unit and an image sensor inside the above-described image reader 951 and transfers an analog image signal output from the image sensor to an image signal control unit 204.

The image signal control unit 204 converts the analog image signal received from the image sensor into a digital signal and performs various processes on the digital signal. The image signal control unit 204 then converts the digital signal to a video signal for printing and outputs the video signal to a printer control unit 205. Further, the image signal control unit 204 performs various processes on a digital signal input from a computer 200 via an external interface (I/F) 201, converts the digital signal into a video signal for printing, and outputs the video signal to a printer control unit 205. The CPU circuit 206 controls the processes performed by the image signal control unit 204.

The printer control unit 205 controls driving of the above-described exposure unit 908 according to the input video signal.

An operation unit 209 includes a plurality of keys for a user to set various functions associated with image forming and includes a display unit for displaying information about the settings. The operation unit 209 outputs to the CPU circuit 206 key signals corresponding to operations on each of the keys. The operation unit 209 also displays a plurality of operation screens on the display unit of the operation unit 209 based on a signal from the CPU circuit 206. A user sets various modes using the operation screens displayed on the display unit of the operation unit 209. The operation screens are described below with references to FIGS. 3 and 4.

A stacker control unit 210 is installed in the stacker apparatus 100. The stacker control unit 210 performs overall control of the stacker apparatus 100 by sending and receiving information to and from the CPU circuit 206. The stacker control unit 210 is described below with reference to FIG. 5.

Figure 3:
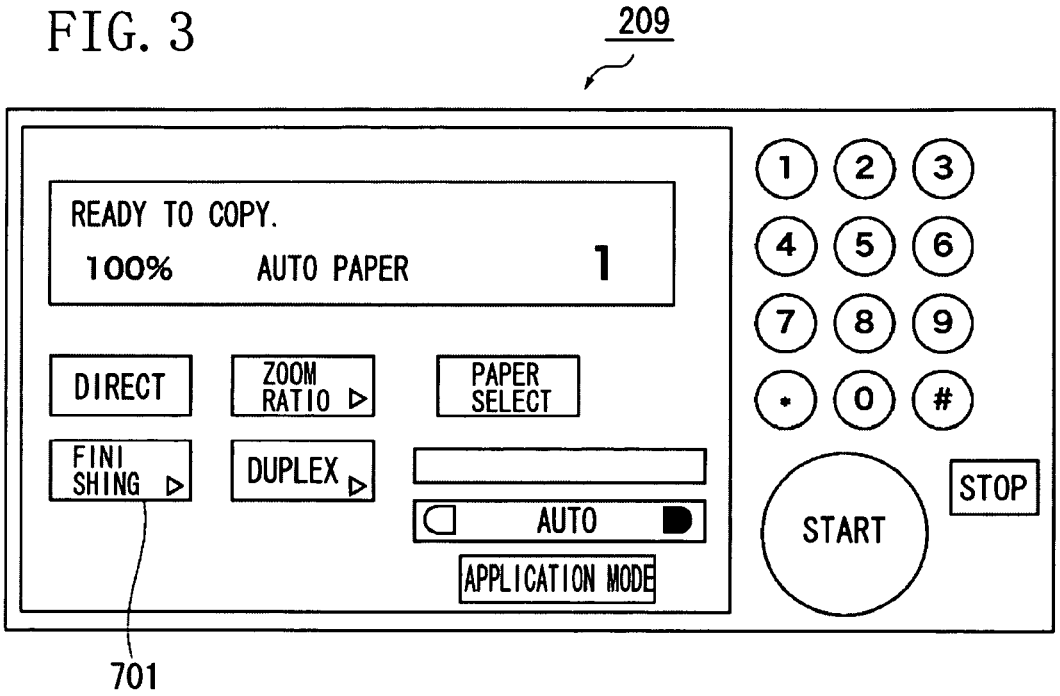
FIG. 3 illustrates an example of a first operation screen displayed on an operation unit of an image forming apparatus according to an exemplary embodiment of the present invention.
Figure 4:
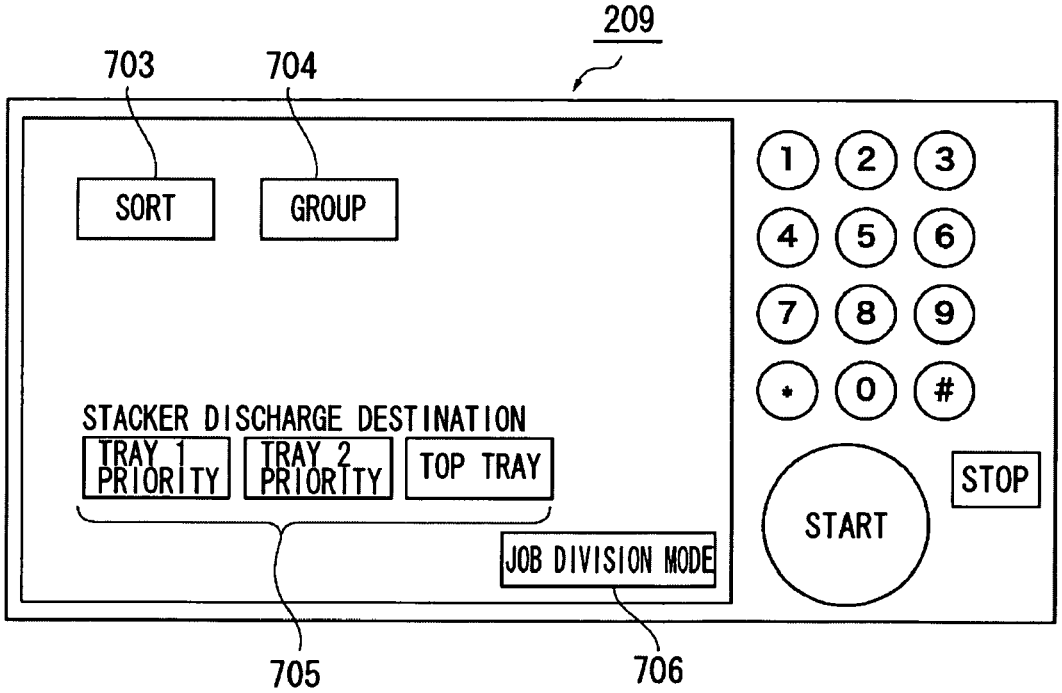
FIG. 4 illustrates an example of a second operation screen displayed on an operation unit of an image forming apparatus according to an exemplary embodiment of the present invention.

FIGS. 3 and 4 respectively illustrate first and second operation screens that are displayed on the operation unit 209 of the image forming apparatus 900. Setting of various modes using such operation screens is described below.

A key 701 in the first operation screen illustrated in FIG. 3 is for setting a method for stacking sheets (i.e., a stacking mode) on which images are formed. When a user presses the key 701, the second operation screen illustrated in FIG. 4 is displayed.

In the second operation screen illustrated in FIG. 4, a key 703 is for setting a sort mode, and a key 704 is for setting a group mode. In the sort mode, sheets are sorted and stacked in units of copies, and in the group mode, sheets are grouped and stacked in units of pages. For example, if an original document consists of pages A, B, and C, and two copies of the document are printed, the sort mode performs printing in an order of A, B, C; A, B, C. On the other hand, the group mode performs printing in an order of A, A; B, B; C, C.

Keys 705 are for designating a discharge destination of a sheet. A discharge destination "tray 1" corresponds to a stacker tray 112*a*, "tray 2" corresponds to a stacker tray 112*b*, and "top tray" corresponds to a top tray 106 (which are described below with reference to FIG. 6).

A key 706 is for selecting a job division mode for stacking. The job division mode is described below with references to FIGS. 19 to 21.

Figure 5:
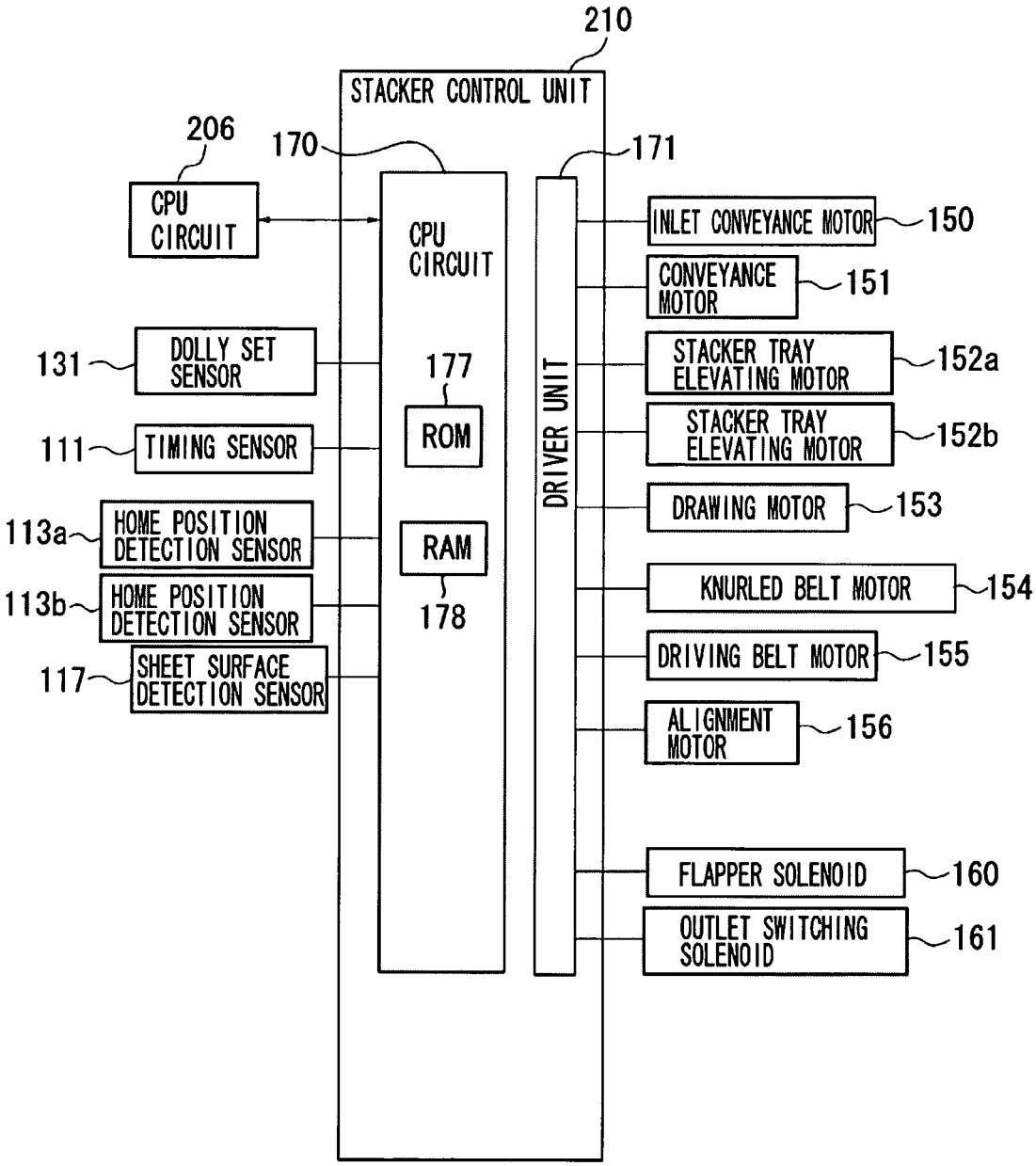
FIG. 5 is an example of a block diagram illustrating an internal configuration of a stacker control unit and various sensors, motors, and solenoids that are connected to the stacker control unit according to an exemplary embodiment of the present invention.

FIG. 5 is a block diagram illustrating an internal configuration of the stacker control unit 210 and various sensors, motors, and solenoids that are connected to the stacker control unit 210.

The stacker control unit 210 includes a CPU circuit 170 and a driver unit 171. The CPU circuit 170 includes a CPU (not illustrated), a read-only memory (ROM) 177, and a random access memory (RAM) 178. The driver unit 171 is connected to various motors 150, 151, 152*a*, 152*b*, 153, 154, 155, and 156 and various solenoids 160 and 161. Further, the CPU circuit 206 and various sensors 131, 111, 113*a*, 113*b*, and 117 are connected to the CPU circuit 170. Control performed by the CPU circuit 170 is described below.

Figure 6:
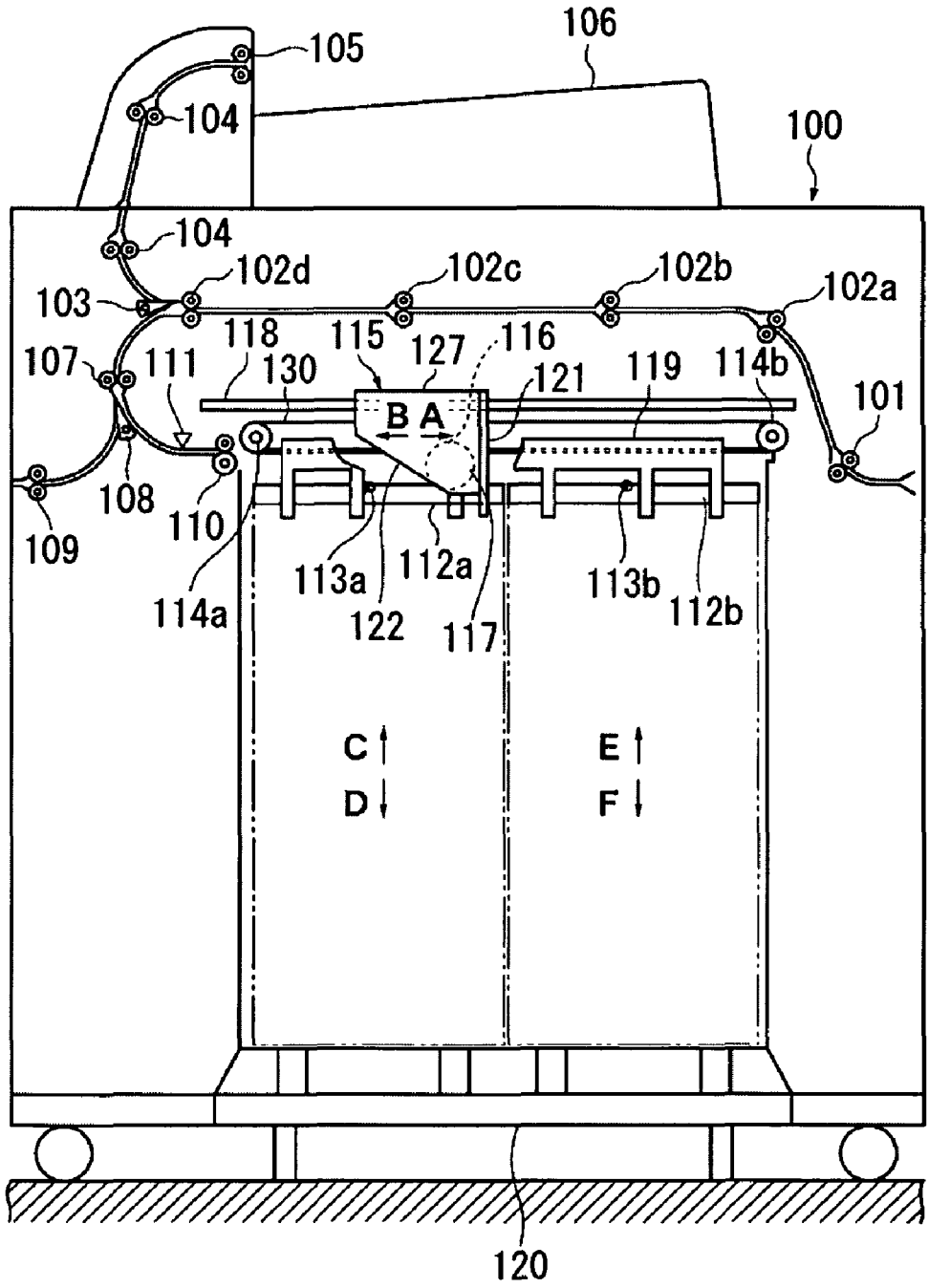
FIG. 6 illustrates a cross-sectional view of an example of a stacker apparatus according to an exemplary embodiment of the present invention.
Figure 7:
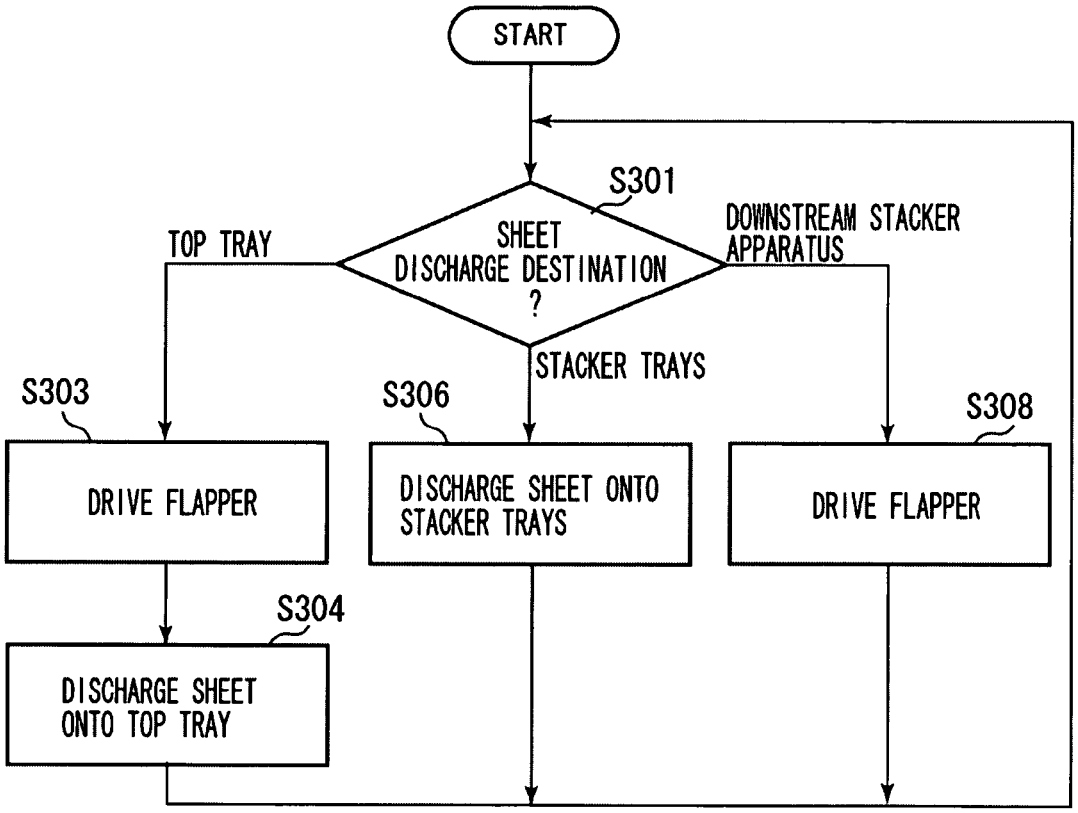
FIG. 7 is a flowchart illustrating a basic operation of a stacker apparatus according to an exemplary embodiment of the present invention.

FIG. 6 illustrates a cross-sectional view of the stacker apparatus 100, and FIG. 7 is a flowchart illustrating a basic operation of the stacker apparatus 100. Operation of the stacker apparatus 100 and control performed by the CPU circuit 170 are described below with reference to FIGS. 5 to 7.

Referring to FIG. 6, a sheet discharged from the apparatus main body 900A (illustrated in FIG. 1) of the image forming apparatus 900 is conveyed into the stacker apparatus 100 by an inlet roller pair 101 of the stacker apparatus 100. Conveyance roller pairs 102*a*, 102*b*, 102*c*, and 102*d* then convey the sheet to a diverter 103. An inlet conveyance motor 150 (illustrated in FIG. 5) drives the inlet roller pair 101 and the conveyance roller pairs 102*a*, 102*b*, 102*c*, and 102*d*. The CPU circuit 206 of the image forming apparatus 900 illustrated in FIG. 2 sends information about the sheet to the stacker control unit 210 before the sheet is conveyed to the stacker apparatus 100. The sheet information includes attributes such as a sheet size, a sheet type, and a discharge destination of the sheet.

In step S301 of the flowchart illustrated in FIG. 7, the CPU circuit 170 of the stacker control unit 210 determines the discharge destination of the sheet based on the received sheet information. As a result, if the sheet discharge destination is the top tray 106 (illustrated in FIG. 6), the process proceeds to step S303. If the sheet discharge destination is the stacker trays 112*a* and 112*b* (illustrated in FIG. 6), the process proceeds to step S306. If the sheet discharge destination is a stacker apparatus (not illustrated) set further downstream from the stacker apparatus 100, the process proceeds to step S308.

In step S303, the CPU circuit 170 drives a flapper solenoid 160 (illustrated in FIG. 5) to switch the diverter 103 so that a leading edge of the diverter 103 is positioned downwards. The CPU circuit 170 also guides the sheet to conveyance roller pairs 104. In step S304, the CPU circuit 170 drives a conveyance motor 151 (illustrated in FIG. 5) so that a discharge roller pair 105 discharges the sheet onto the top tray 106 to be stacked.

In step S306, the CPU circuit 170 discharges the sheet onto the stacker trays 112*a* and 112*b*, as illustrated in FIG. 6. In particular, the sheet conveyed by the conveyance roller pair 102*d* is guided to the diverter 103, whose leading edge is switched to an upward position by the flapper solenoid 160 (illustrated in FIG. 5), and is conveyed by a conveyance roller pair 107. The sheet is then guided to a discharge roller pair 110 by an outlet diverter 108 whose leading edge is switched to a leftward position by the outlet switching solenoid 161. As a result, the discharge roller pair 110 sends the sheet to grippers 114*a* and 114*b*, and the sheet is selectively discharged and stacked on the stacker trays 112*a* and 112*b*. Such a discharge process is described in detail below.

In step S308, the CPU circuit 170 switches the leading edge of the outlet diverter 108 to a rightward position. The sheet conveyed by the conveyance roller pair 102*d* is guided to an outlet roller pair 109 by the conveyance roller pair 107 and conveyed to the stacker apparatus which is positioned downstream.

The stacker apparatus 100 includes two stacker trays (sheet stacking trays) 112*a* and 112*b* to stack sheets and selectively discharges the sheets onto the stacker trays 112*a* and 112*b*. The stacker trays 112*a* and 112*b* can each stack small-size (smaller than or equal to A4 size) sheets. Further, large-size (B4 or A3 size) sheets can be stacked by using both stacker trays 112*a* and 112*b*.

A selective discharge of sheets onto the stacker trays 112*a* and 112*b* is described below.

The peripheral configuration of the stacker tray 112*a* and 112*b* in the stacker apparatus 100 is described below with reference to FIG. 6.

The stacker trays 112*a* and 112*b* are positioned such that they can move upward and downward in the directions indicated by arrows C, D, E, and F by stacker tray elevating motors 152*a* and 152*b*.

A sheet drawing unit 115 includes a frame 127 which is movable along a slide shaft 118. A drawing motor 153 (illustrated in FIG. 5) moves the sheet drawing unit 115 in directions indicated by arrows A and B. The frame 127 of the sheet drawing unit 115 includes a stopper 121 on which a leading edge of the sheet abuts. The frame 127 also includes a taper unit 122 which guides the sheet to the stopper 121. Further, the sheet drawing unit 115 includes a knurled belt 116 which is elastic and which guides the sheet to the stopper 121.

The knurled belt 116 is rotated counter-clockwise by a knurled belt motor 154 (illustrated in FIG. 5) and guides the sheet to a gap between the knurled belt 116 and the stacker tray 112*a* (or the stacker tray 112*b*). As a result, the leading edge of the sheet abuts on the stopper 121. A sheet surface detection sensor 117 is built into the sheet drawing unit 115 and is used to keep a constant distance between the sheet drawing unit 115 and the upper surface of the sheet.

The grippers 114*a* and 114*b* grip the leading edge of the sheet and convey the sheet. The grippers 114*a* and 114*b* are mounted on a driving belt 130 biased by a torsion coil spring (not illustrated) in a direction of gripping the sheet. The sheet discharged from the discharge roller pair 110 is then pushed into between the gripper 114*a* and the driving belt 130 or between the gripper 114*b* and the driving belt 130 to be gripped thereby. The grippers 114*a* and 114*b* can have the following structure. That is, each of the grippers 114*a* and 114*b* has a V-shaped opening and elastic bodies, such as sponges, are provided on both surfaces of the V-shaped opening. A conveyed sheet can be held between the elastic bodies of the opening.

The discharged sheet is stacked on the stacker trays 112*a* and 112*b*. When no sheets are stacked, the stacker trays 112*a* and 112*b* each stand by in a home position for stacking sheets. The position of the stacker trays 112*a* and 112*b* are detected by home position detection sensors 113*a* and 113*b* respectively, and the stacker trays 112*a* and 112*b* are moved to the home positions according to the detection results.

Reference is now made also to FIGS. 8, 9, 10, and 11. FIGS. 8, 9, 10, and 11 are cross-sectional views illustrating a peripheral configuration of the stacker tray 112*a* in the stacker apparatus 100 illustrated in FIG. 6.

Figure 8:
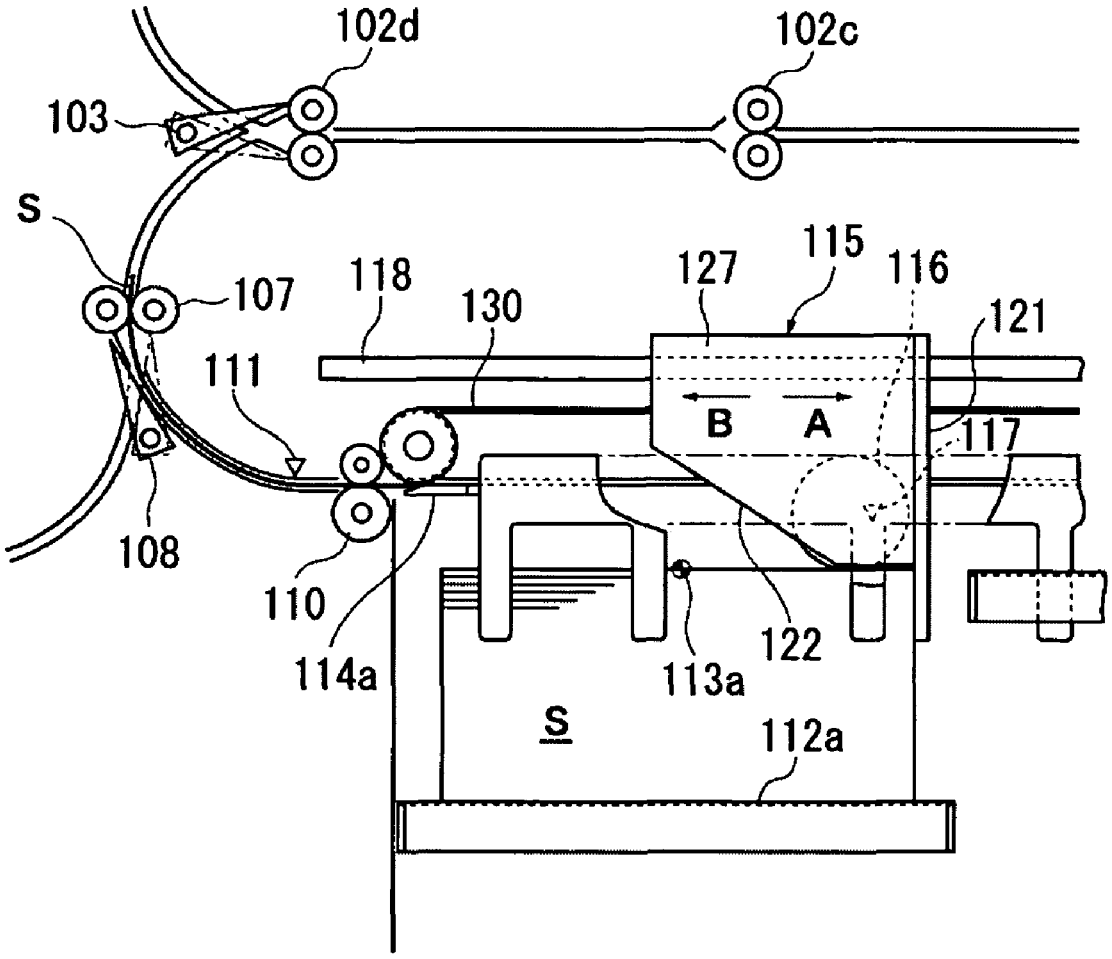
FIG. 8 illustrates a cross-sectional view of an example of a peripheral configuration of a first stacker tray included in the stacker apparatus illustrated in FIG. 6 according to an exemplary embodiment of the present invention.
Figure 9:
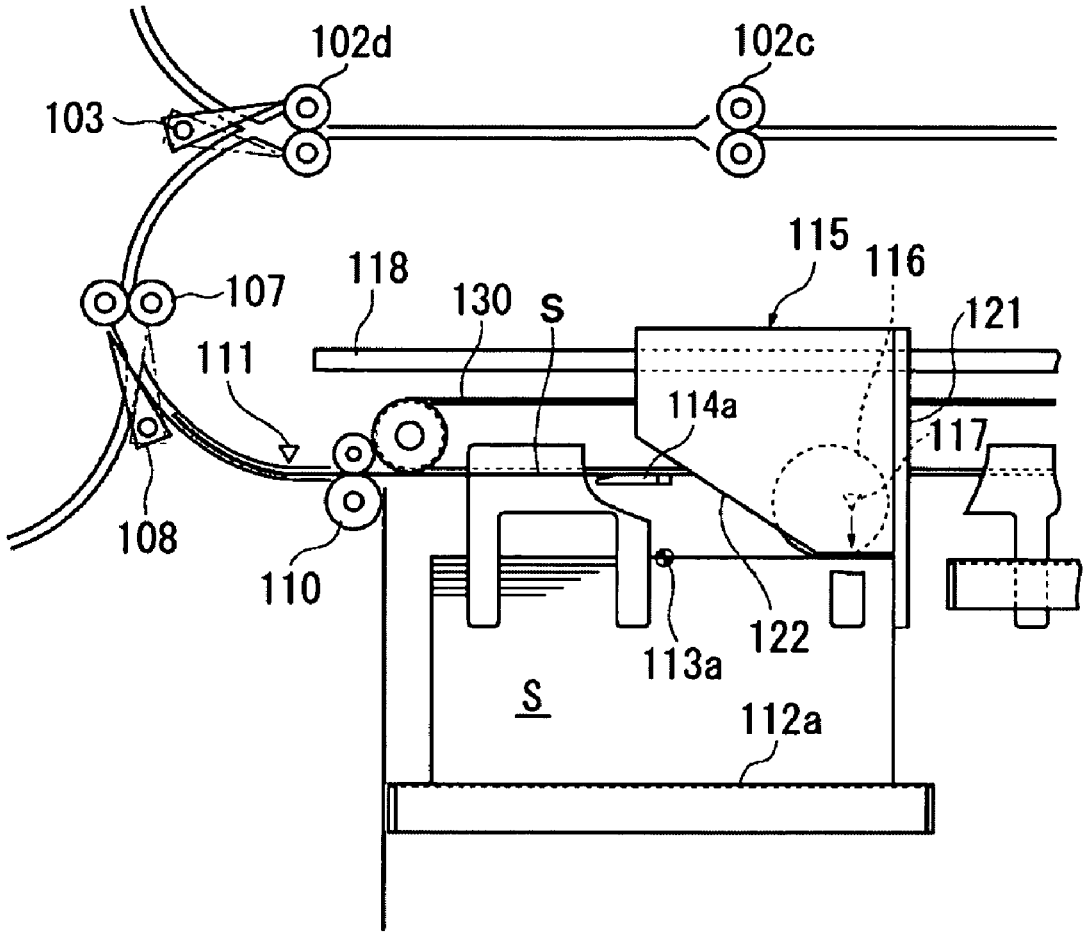
FIG. 9 illustrates another cross-sectional view of an example of a peripheral configuration of the first stacker tray included in the stacker apparatus illustrated in FIG. 6 according to an exemplary embodiment of the present invention.

Referring to FIG. 8, the sheet S is discharged from the apparatus main body 900A (illustrated in FIG. 1) of the image forming apparatus 900 and conveyed to the discharge roller pair 110. A timing sensor 111 which is positioned upstream of the discharge roller pair 110 detects the timing at which the leading edge of the sheet passes. The gripper 114*a*, which is standing by, grips the leading edge of the sheet S at the detected timing. In sync with the gripping of the gripper 114*a*, the driving belt 130 starts to rotate, and the gripper 114*a* moves towards the sheet drawing unit 115 while gripping the sheet S as illustrated in FIG. 9.

Figure 10:
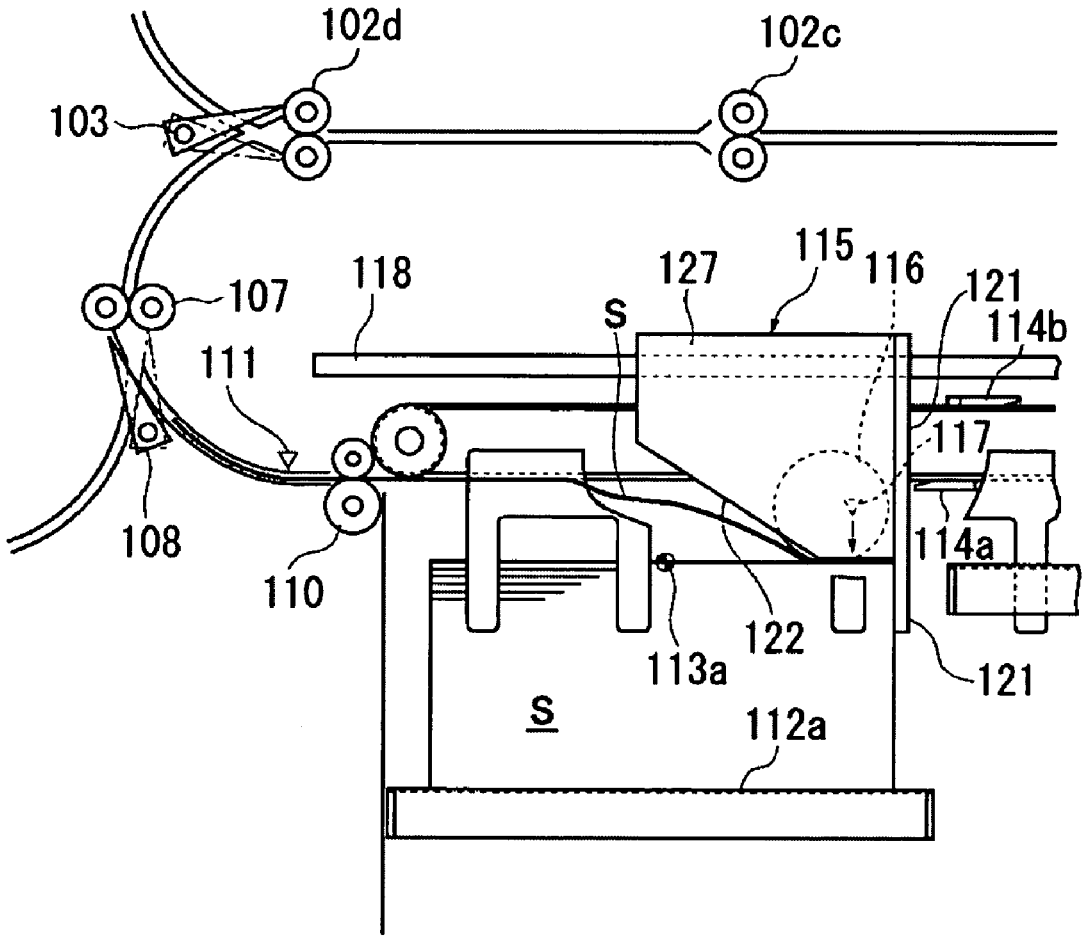
FIG. 10 illustrates another cross-sectional view of an example of a peripheral configuration of the first stacker tray included in the stacker apparatus illustrated in FIG. 6 according to an exemplary embodiment of the present invention.
Figure 11:
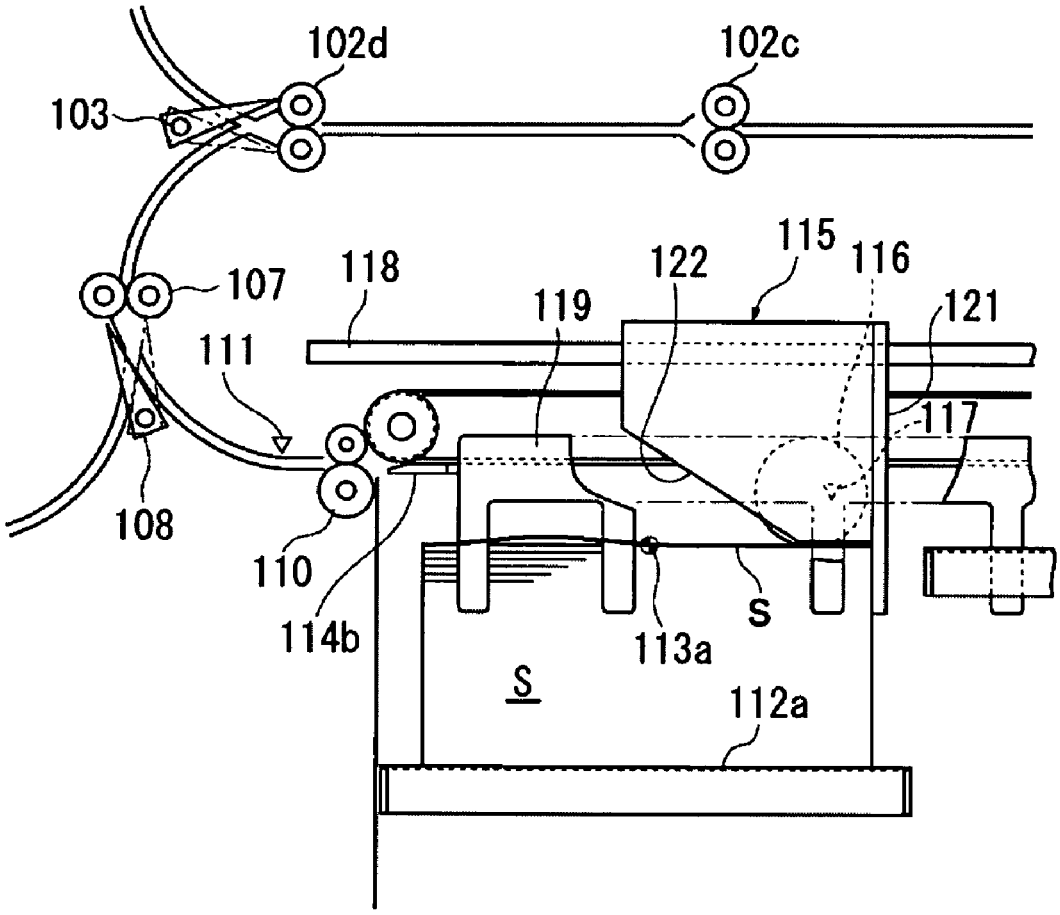
FIG. 11 illustrates another cross-sectional view of an example of a peripheral configuration of the first stacker tray included in the stacker apparatus illustrated in FIG. 6 according to an exemplary embodiment of the present invention.

Referring to FIG. 10, when the gripper 114*a* passes through the taper unit 122 of the sheet drawing unit 115, the gripper 114*a* releases the sheet S. The sheet S is guided to the taper unit 122 by momentum of the conveyance and is pushed to the side of the stacker tray 112*a*. The sheet S then enters between the knurled belt 116 and the stacker tray 112*a* (or the top sheet in a case where sheets are already stacked on the stacker tray 112*a*). The knurled belt 116 conveys the sheet S until the leading edge of the sheet S abuts on the stopper 121 as illustrated in FIG. 11. As a result, the leading edge of the sheet S is aligned, and the sheet S is stacked on the stacker tray 112*a* or on the top sheet stacked thereon.

An alignment plate 119 then aligns the side edge of the sheet (alignment in a width direction) by jogging the sheet in a direction perpendicular to the sheet conveying direction (i.e., a direction of the sheet width).

The sheet surface detection sensor 117 constantly monitors the upper surface of the sheet stacked on the stacker tray 112*a*. When the space between the knurled belt 116 of the sheet drawing unit 115 and the sheet becomes narrower than a first predetermined amount, the stacker tray elevating motor 152*a* lowers the stacker tray 112*a* by a second predetermined amount. As a result, the space between the knurled belt 116 and the sheet is maintained within a predetermined range.

In the stacker apparatus 100, the driving belt 130 which is driven by the driving belt motor 155 (illustrated in FIG. 5) rotates so that the two grippers 114*a* and 114*b* alternately grip a sheet and sequentially stack the sheets onto the stacker tray 112*a*.

Whether the sheets are fully-stacked on the stacker tray 112*a* can be determined as described below. The timing sensor 111 first detects the sheet S which is conveyed by the discharge roller pair 110. The stacker control unit 210 (illustrated in FIG. 2) counts the number of times that the timing sensor 111 has detected the sheets. The stacker control unit 210 also detects the number of stacked sheets. Whether the sheets are fully-stacked on the stacker tray 112*a* can be determined by comparing the detected number of stacked sheets with a previously set upper limit on a stacking capacity. For example, in the present exemplary embodiment, the maximum stacking capacity for plain paper sheets on the stacker trays 112*a* and 112*b* is 5000 sheets. A user inputs the above-described upper limit via the operation unit 209 of the image forming apparatus 900 or an operation screen (not illustrated) of the computer 200. A user can set an upper limit at less than or equal to the maximum stacking capacity.

Whether the sheets are fully-stacked can also be determined by measuring a stacking time that is the elapsed time after stacking of the sheets on the stacker tray 112*a* started. The measured result is compared with a previously set upper limit on the stacking time.

Further, whether the sheets are fully-stacked can be detected by detecting the lowered position of the stacker tray 112*a* and the position of the top sheet.

Figure 12:
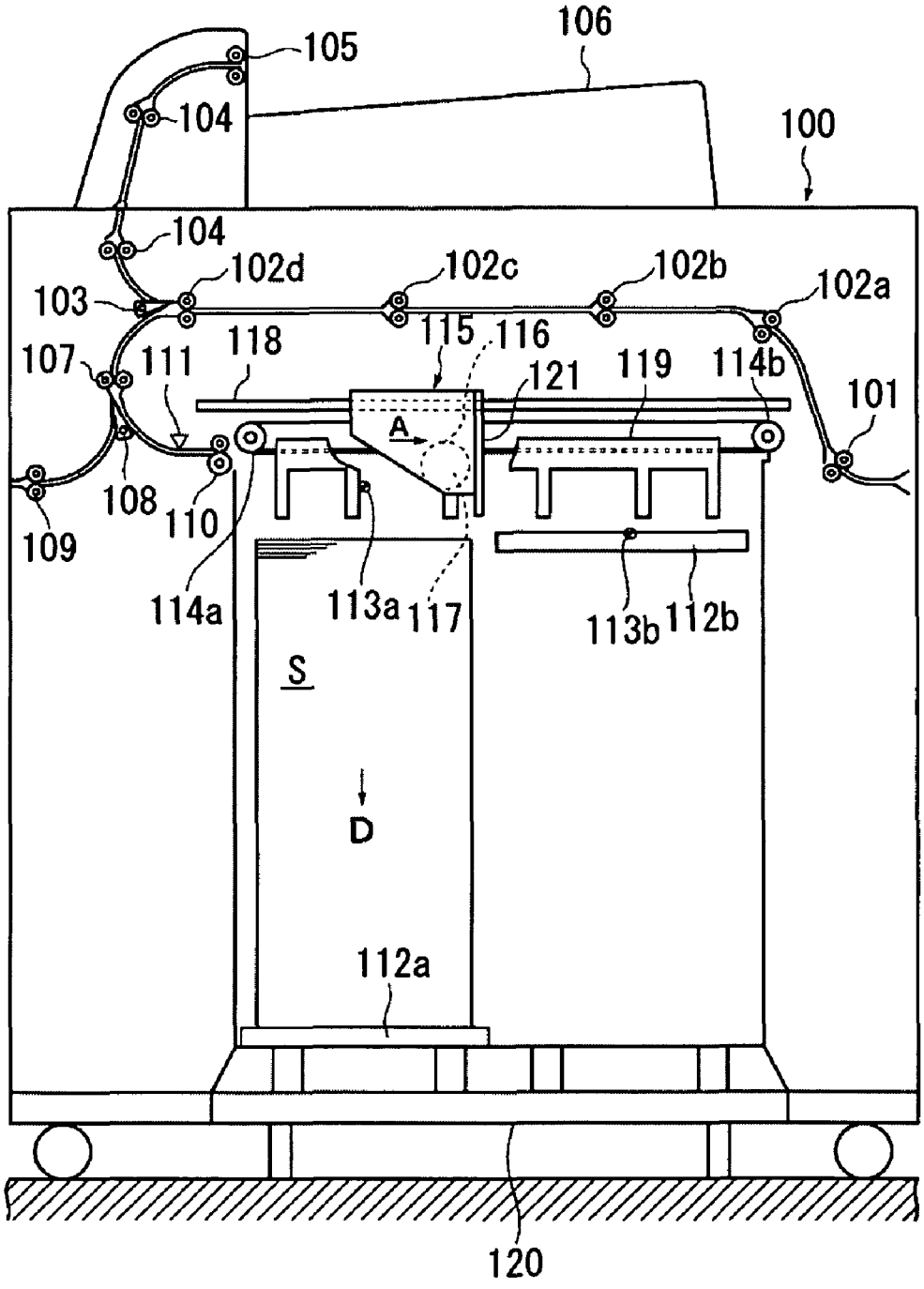
FIG. 12 illustrates a cross-sectional view of an example of a stacker apparatus in which a first stacker tray is lowered on top of a dolly according to an exemplary embodiment of the present invention.

Referring now also to FIG. 12, in a case where the sheets on the stacker tray 112*a* are fully-stacked, the stacker control unit 210 (illustrated in FIG. 2) lowers the stacker tray 112*a*, as illustrated in FIG. 12, and places the stacked sheets and the stacker tray 112*a* onto a dolly 120. Loading of the dolly 120 in the stacker 100 is detected by the dolly set sensor 131. The dolly transports the sheets together with the stacker tray 112*a*. The sheet drawing unit 115 then moves in a direction indicated by an arrow A, and the stacker tray 112*b* waits for sheets to be stacked. FIG. 12 illustrates a cross-sectional view of the stacker apparatus 100 in which the stacker tray 112*a* is lowered onto the dolly 120.

Figure 13:
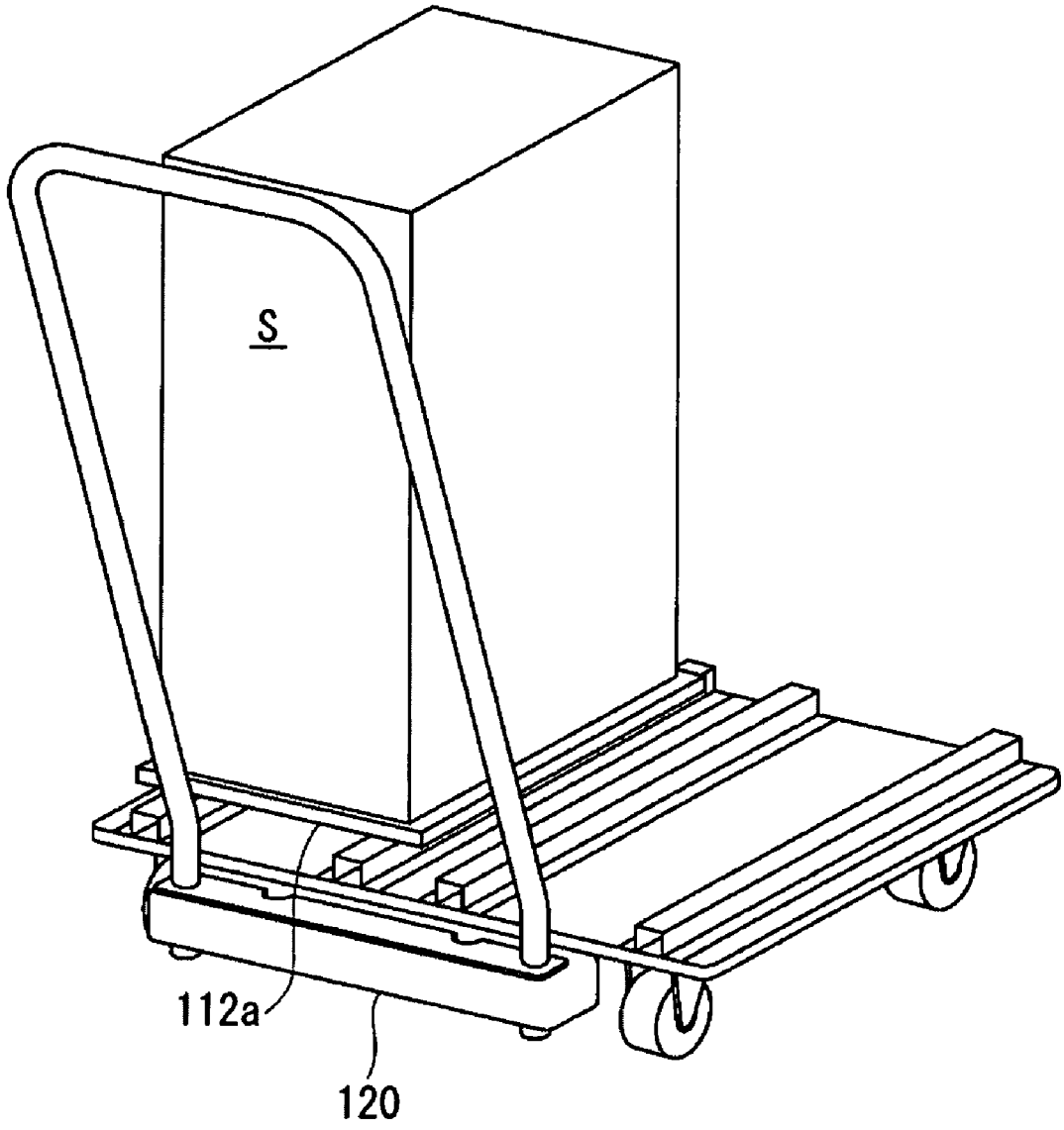
FIG. 13 illustrates how a first stacker tray on which sheet stacks are fully-stacked is taken out by a dolly according to an exemplary embodiment of the present invention.

Referring to FIG. 12, the stacker tray 112*a* on which sheets that equal the set maximum stacking capacity are stacked, is placed on the dolly 120. FIG. 13 illustrates how the stacker tray 112*a* is removed using the dolly 120. Referring to FIG.

13, a user can remove the stacker tray 112*a* on which the sheets are stacked using the dolly 120 even if sheets are being stacked on the stacker tray 112*b* or images are being formed. Therefore, in the image forming apparatus 900, a user can remove sheets that are stacked on a stacker tray while sheets on which images are formed are being stacked on another stacker tray.

It is desirable that the standby position of the sheet drawing unit 115 is at approximate center of each sheet to be stacked on the stacker trays 112*a* and 112*b* to maintain stability. However, in order to stack a large amount of sheets, the standby position of the sheet drawing unit 115 can be arranged at other positions as long as each sheet to be stacked is in a range that the sheet does not run off the stacker trays 112*a* and 112*b*.

Figure 14:
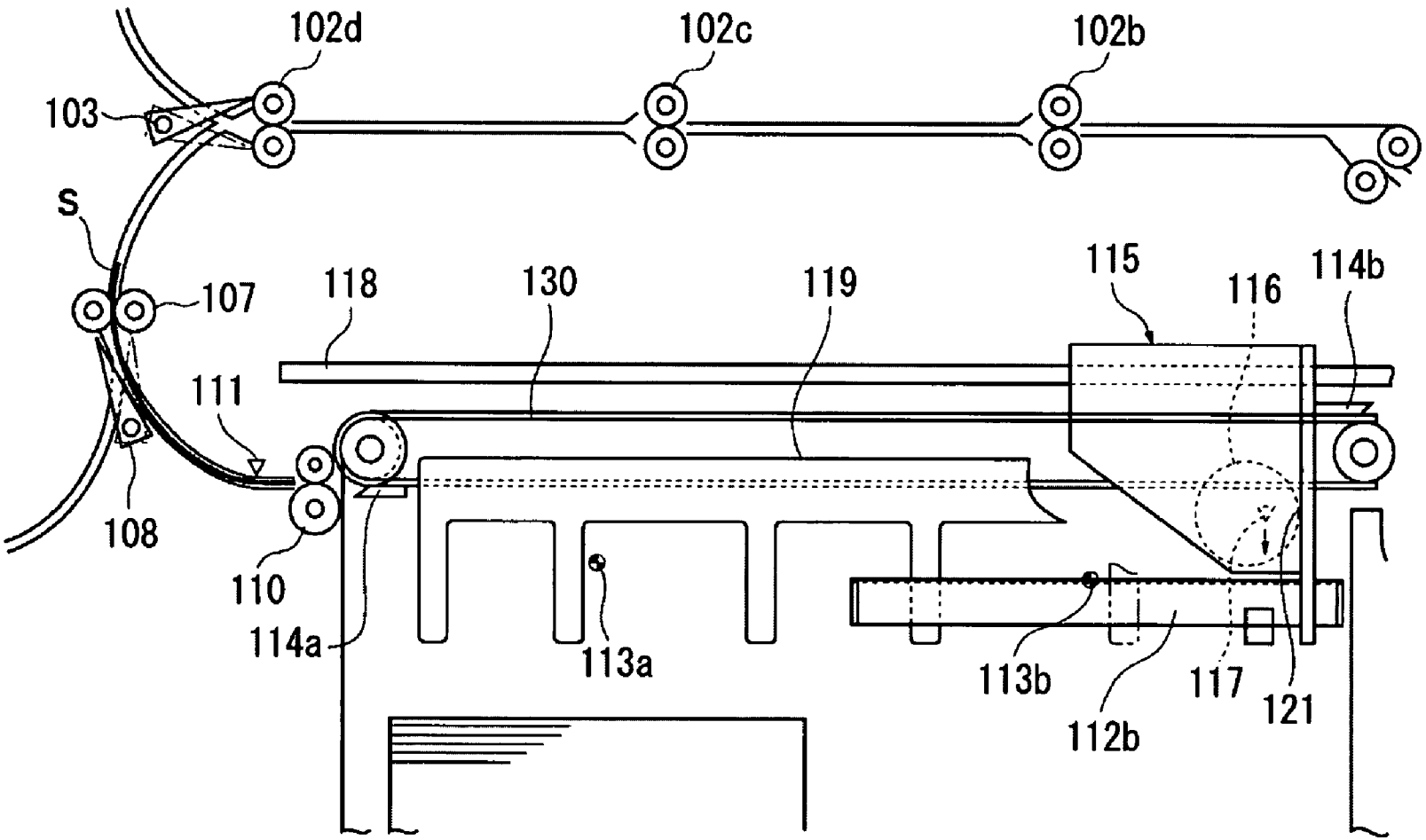
FIG. 14 illustrates a cross-sectional view of an example of a peripheral configuration of a second stacker tray included in the stacker apparatus illustrated in FIG. 6 according to an exemplary embodiment of the present invention.
Figure 15:
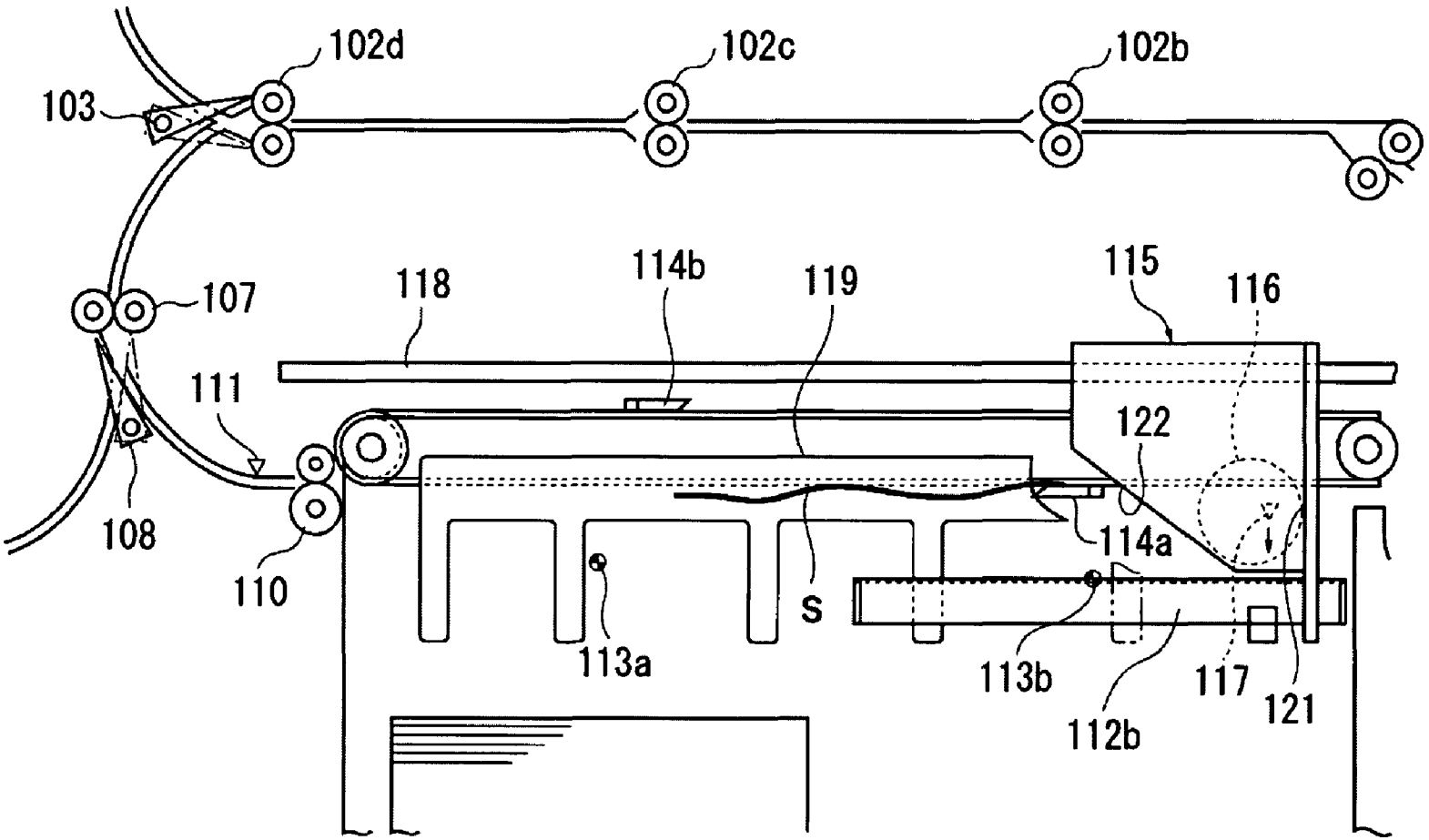
FIG. 15 illustrates another cross-sectional view of an example of a peripheral configuration of the second stacker tray included in the stacker apparatus illustrated in FIG. 6 according to an exemplary embodiment of the present invention.
Figure 16:
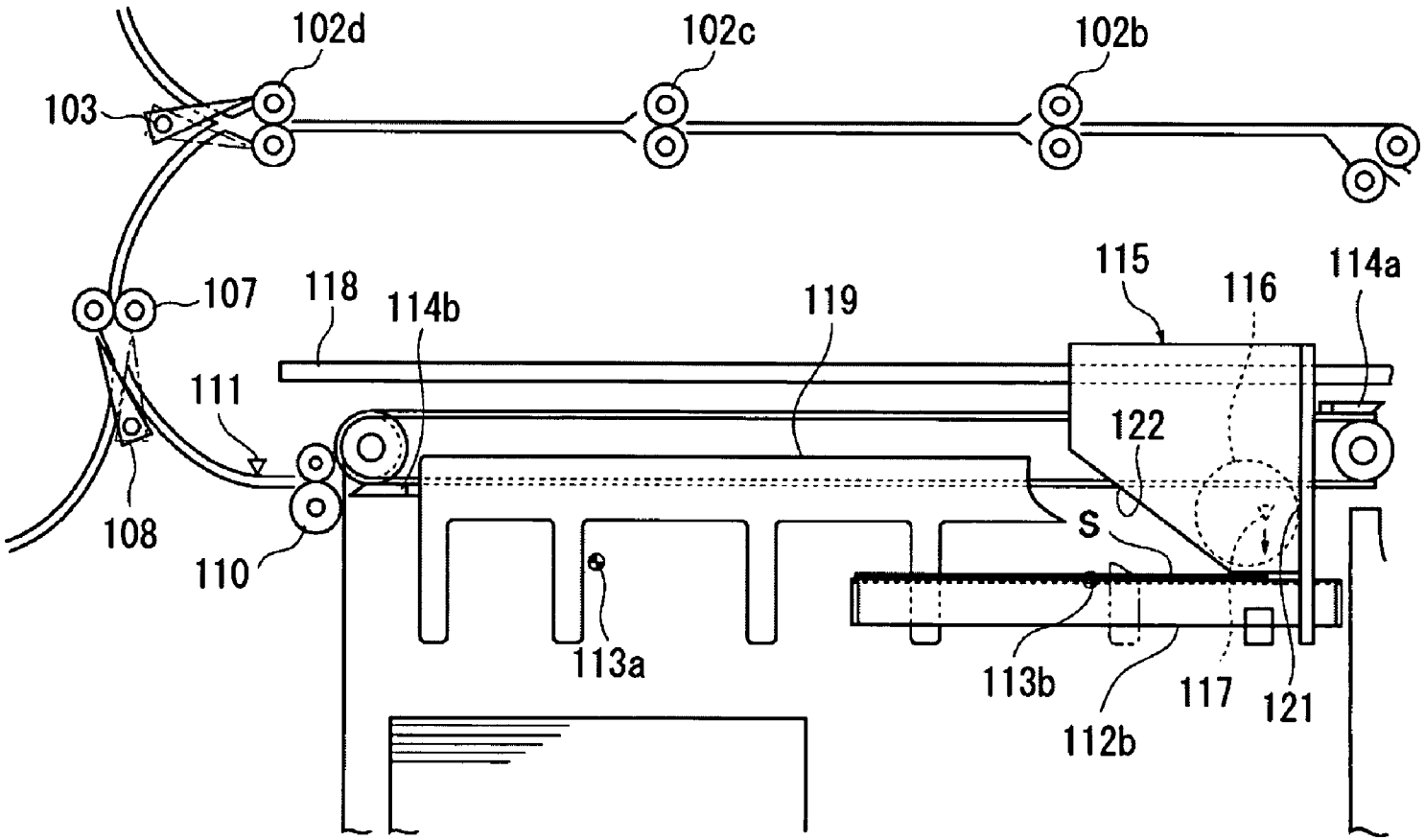
FIG. 16 illustrates another cross-sectional view of an example of a peripheral configuration of the second stacker tray included in the stacker apparatus illustrated in FIG. 6 according to an exemplary embodiment of the present invention.

Reference is now made also to FIGS. 14, 15, and 16 which illustrate cross-sectional views of a peripheral configuration of the stacker tray 112*b* in the stacker apparatus 100 illustrated in FIG. 6.

In FIG. 14, the sheet S is discharged from the apparatus main body 900A of the image forming apparatus 900. After passing through the timing sensor 111, the sheet S is discharged by the discharge roller pair 110, and the leading edge of the sheet S is gripped by the gripper 114*a*.

In FIG. 15, the gripper 114*a* then passes through the taper unit 122 of the sheet drawing unit 115, and the leading edge of the sheet S is pushed toward the stacker tray 112*b* by the taper unit 122. The sheet S moves along the taper unit 122 and is guided to the knurled belt 116.

In FIG. 16, the knurled belt 116 causes the leading edge of the sheet S to abut on the stopper 121. The sheet S whose leading edge is aligned is stacked on the stacker tray 112*b*, and the side edge of the sheet S is further aligned by the aligning plate 119 drove by the alignment motor 156.

The sheet surface detection sensor 117 constantly monitors the top surface of the sheet stacked on the stacker tray 112*b*. When the space between the knurled belt 116 of the sheet drawing unit 115 and the sheet becomes narrower than a predetermined distance, the stacker tray elevating motor 152*b* (illustrated in FIG. 5) is driven, and the stacker tray 112*b* is lowered by a predetermined amount. As a result, the space between the knurled belt 116 and the sheet is maintained within a predetermined range.

In the stacker apparatus 100, the driving belt 130 rotates, and the two grippers 114*a* and 114*b* that are mounted on the driving belt 130 alternately grip the sheet, so that the grippers 114*a* and 114*b* sequentially stack each sheet on the stack tray 112*b*.

Determination of whether the sheets are fully-stacked on the stacker tray 112*b* is made in the same manner as (or alternatively a similar manner to) the determination performed for the stacker tray 112*a*. In particular, the timing sensor 111 detects the sheet S which is conveyed by the discharge roller pair 110, and the stacker control unit 210 (illustrated in FIG. 2) counts the number of sheets discharged. Whether the sheets are fully-stacked on the stacker tray 112*b* can be detected by comparing the detected number of discharged sheets with a previously set upper limit on a stacking capacity.

Whether the sheets are fully-stacked can also be determined by measuring stacking time that is the elapsed time after stacking of the sheets on the stacker tray 112*b* started and comparing the result with a previously set upper limit on the stacking time.

Further, whether the sheets are fully-stacked can be determined by detecting the lowered position of the stacker tray 112*b* and the position of the top sheet.

Figure 17:
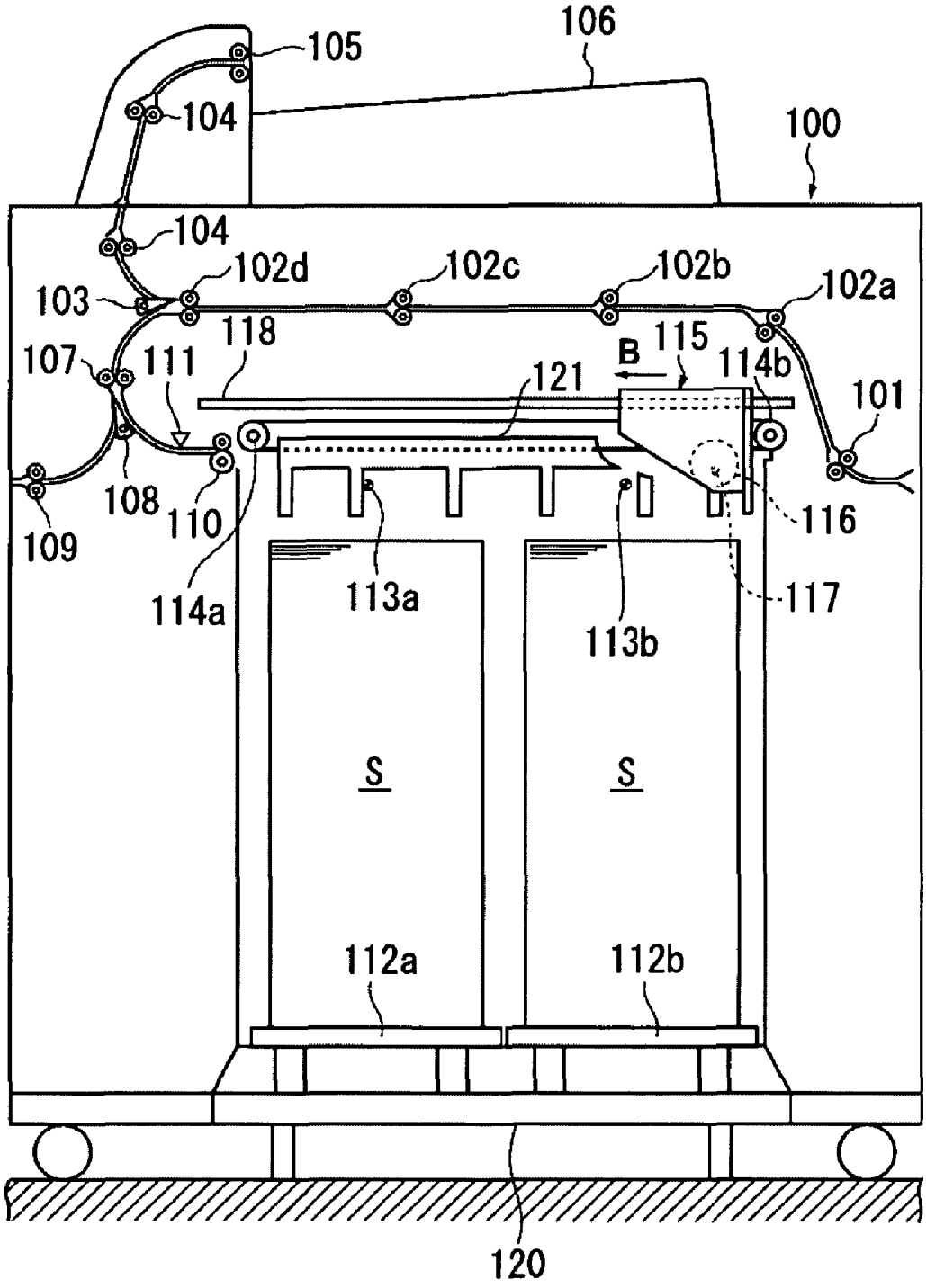
FIG. 17 illustrates a cross-sectional view of an example of a stacker apparatus in which a second stacker tray is lowered on top of a dolly according to an exemplary embodiment of the present invention.

In a case where the stacker tray 112*b* are fully-stacked with sheets, the stacker control unit 210 (illustrated in FIG. 2) lowers the stacker tray 112*b*, for example, as illustrated in FIG. 17 and places the stacker tray 112*b* onto the dolly 120. FIG. 17 is a cross-sectional view of the stacker apparatus 100 in which the stacker trays 112*a* and 112*b* are lowered down to a position where they rest on the dolly 120. Alternatively, a user can remove the stacker tray 112*b* on which the sheets are stacked using the dolly 120 even if sheets are being stacked on the stacker tray 112*a* or images are being formed.

The sheet drawing unit 115 then moves in the direction indicated by an arrow B and stands by above the stacker tray 112*a* on the left side of the stacker trays 112*a* and 112*b*.

Figure 18:
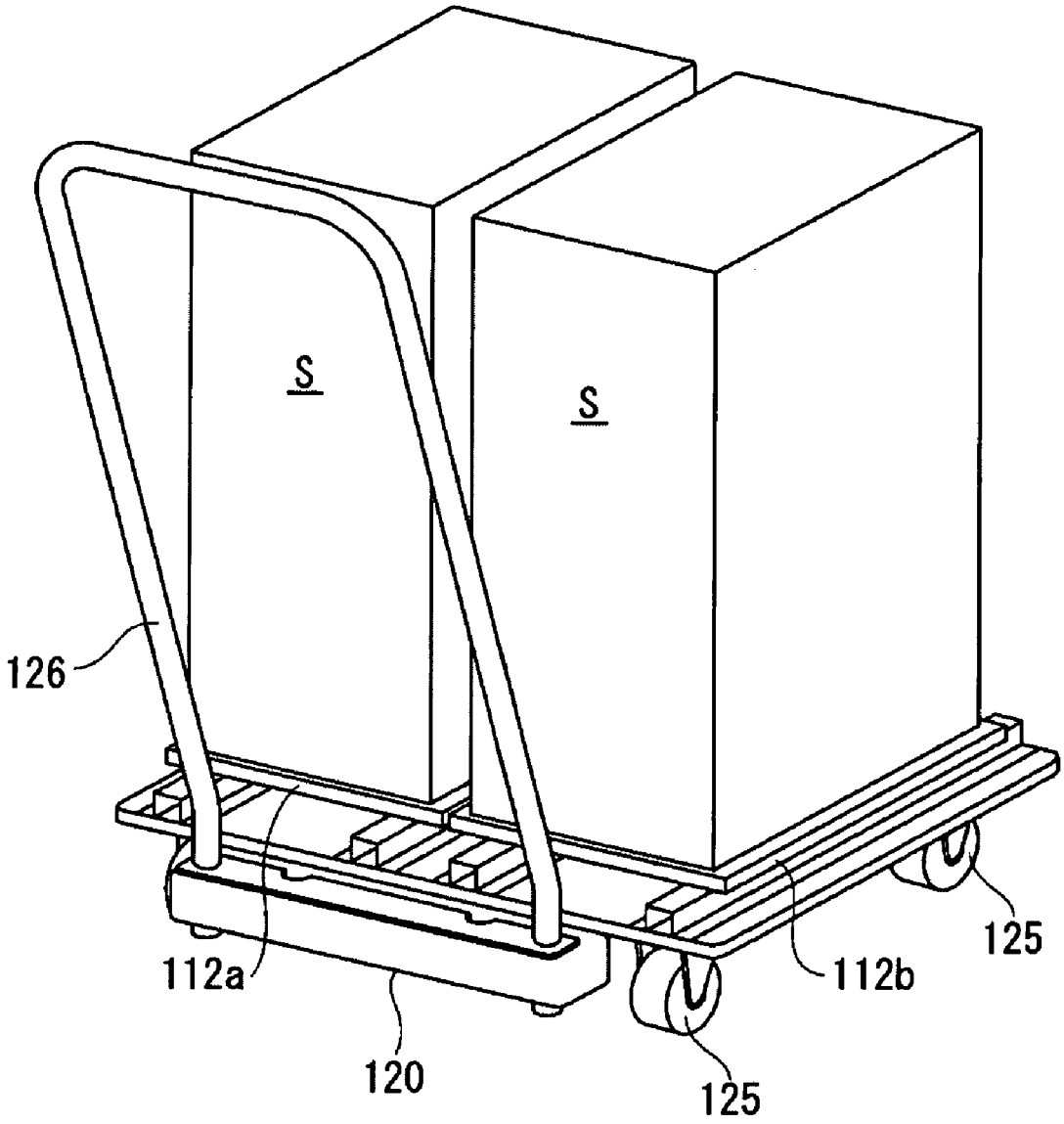
FIG. 18 illustrates a perspective view of two stacker trays and a dolly according to an exemplary embodiment of the present invention.

FIG. 18 illustrates a perspective view of the stacker trays 112*a* and 112*b* and the dolly 120.

The stacker trays 112*a* and 112*b* are supported by a supporting member (not illustrated) that can be elevated. The stacker trays 112*a* and 112*b* are transferred to the dolly 120 by the supporting member that is lowered below the supporting surface of the dolly 120. As illustrated in FIG. 18, the stacker trays 112*a* and 112*b* are fixed on the dolly 120 by a fixing member such as a pin which is set on the upper surface of the dolly 120, and a large volume of sheet stacks can be stacked on the stacker trays 112*a* and 112*b*. The dolly 120 includes casters 125 and a handle 126, and a user can easily move a large volume of sheet stacks at once by holding the handle 126 of the dolly 120.

After the dolly 120 on which the stacker trays 112*a* and 112*b* are placed is taken out from the stacker apparatus 100, the image forming operation is stopped. The image forming operation can be restarted when the sheet stacks on the stacker trays 112*a* and 112*b* on the dolly 120 are removed and the stacker trays 112*a* and 112*b* and the dolly 120 are re-loaded onto the stacker apparatus 100. The image forming operation can be promptly restarted by providing an auxiliary dolly and two stacker trays to the stacker apparatus 100.

A stacking mode changing process (an example of a sheet stacking control method) is described below with reference to FIG. 19.

Figure 19:
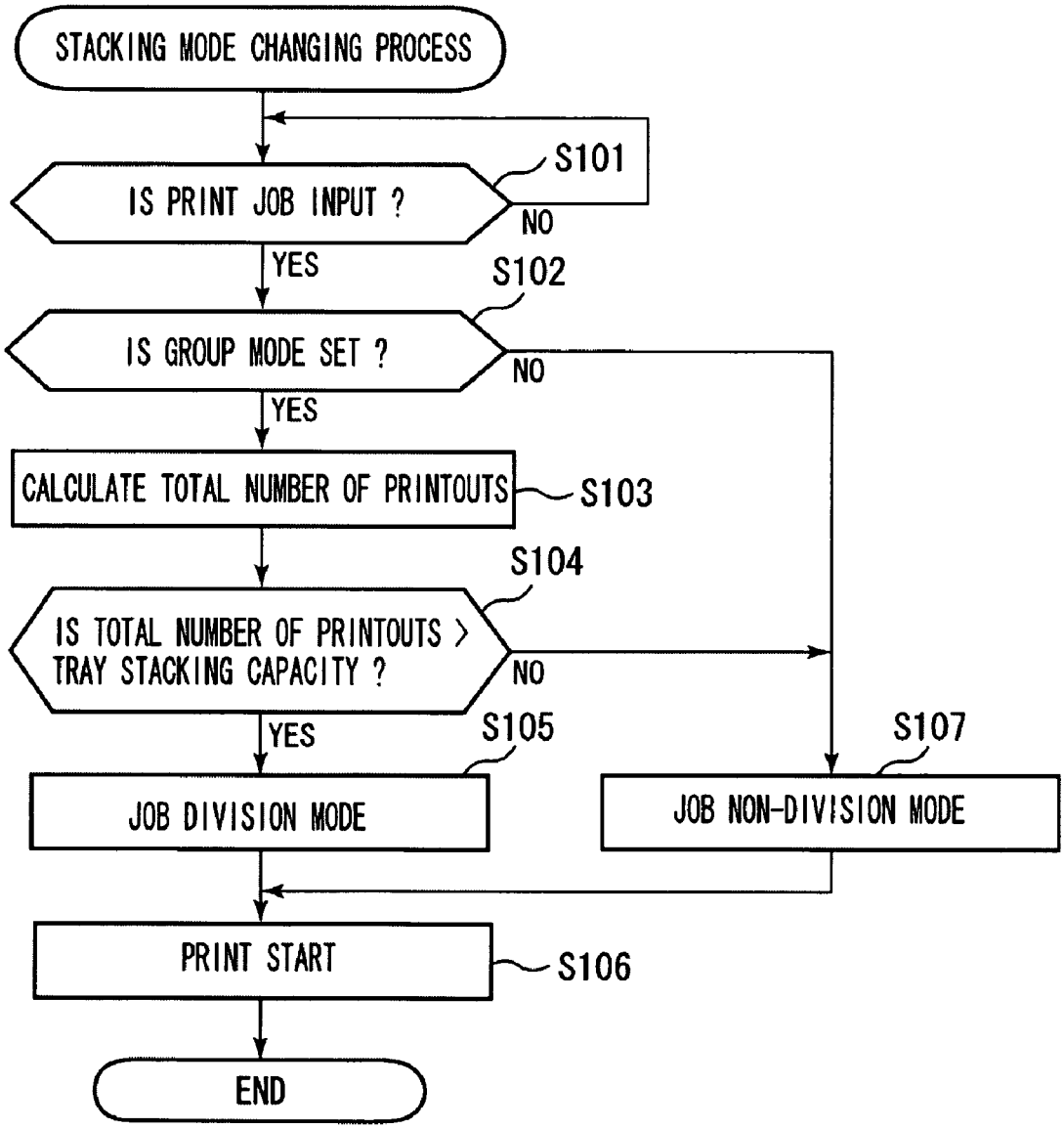
FIG. 19 is a flowchart illustrating a stacking mode changing process performed by a stacker control unit illustrated in FIG. 5 according to an exemplary embodiment of the present invention.

FIG. 19 is a flowchart illustrating a stacking mode changing process that is performed by the stacker control unit 210. The CPU circuit 170 executes the stacking mode changing process when a user selects the job division mode key 706 on the second operation screen of the operation unit 209 illustrated in FIG. 4. The CPU circuit 170 includes a determination unit to determine whether a group mode is set and a decision unit to decide whether to divide a job into a plurality of print jobs.

In step S101, the CPU circuit 170 waits for a print job to be input (NO in step S101). If a print job is input (YES in step S101), the process proceeds to step S102.

In step S102, the CPU circuit 170 determines whether a group mode is designated as a stacking method in the input print job. If the group mode is designated (YES in step S102), the process proceeds to step S103. On the other hand, if a mode other than the group mode, e.g., a sort mode, is designated (NO in step S102), the process proceeds to step S107.

In step S107, the CPU circuit 170 sets a normal job non-division mode, and the process proceeds to step S106. In the normal job non-division mode, the sheets are stacked on the stacker tray according to the designated stacking method. For example, if the sort mode is designated as the stacking method, the sheets are stacked in units of copies of a document. If the group mode is designated as the stacking method, the sheets are stacked in units of pages.

In step S103, the CPU circuit 170 analyzes the input print job and calculates the total number of sheets to be printed (total number of printouts) in the print job.

In step S104, the CPU circuit 170 determines whether the calculated total number of sheets to be printed is greater than an upper limit on a number of sheets to be stacked (upper limit on a stacking capacity) in a stacker tray on which the sheets are currently to be stacked. For example, the upper limit on stacking capacity can be, for example, the maximum stacking capacity of the stacker tray.

If the total number of sheets to be printed is greater than the upper limit on the stacking capacity (YES in step S104), the process proceeds to step S105. On the other hand, if the total number of sheets to be printed is less than or equal to the upper limit (NO in step S104), the process proceeds to step S107.

In step S105, the CPU circuit 170 sets a job division mode, which is described below.

After executing the processes of step S105 or step S107, the process proceeds to step S106 wherein the CPU circuit 170 starts the print job, after which the stacking mode changing process ends.

The job division mode is described below with reference to FIGS. 20 and 21. In the job division mode, a print job which prints M copies (where M is an integer) of each page one through N (where N is an integer) of images is divided into a plurality of print jobs which each print less than M copies of each page one through N of the images. The job division mode changes the order of printing so that printing of less than M copies of page one through N of images is repeated. In each of the divided print jobs, the product of a number of printouts for each page and N is less than or equal to the upper limit on a stacking capacity of a stacker tray. For example, a print job is divided into a first divided print job and a second divided print job, where the first divided print job prints $M_1$ copies of each page one through N of images, and the second divided print job prints $M_2$ copies of each page one through N of images. In such a case, $N*M_1$ and $N*M_2$ are each less than or equal to the upper limit on the stacking capacity of a stacker tray. The same result is achieved when the print job is divided into three or more jobs.

Figure 20:
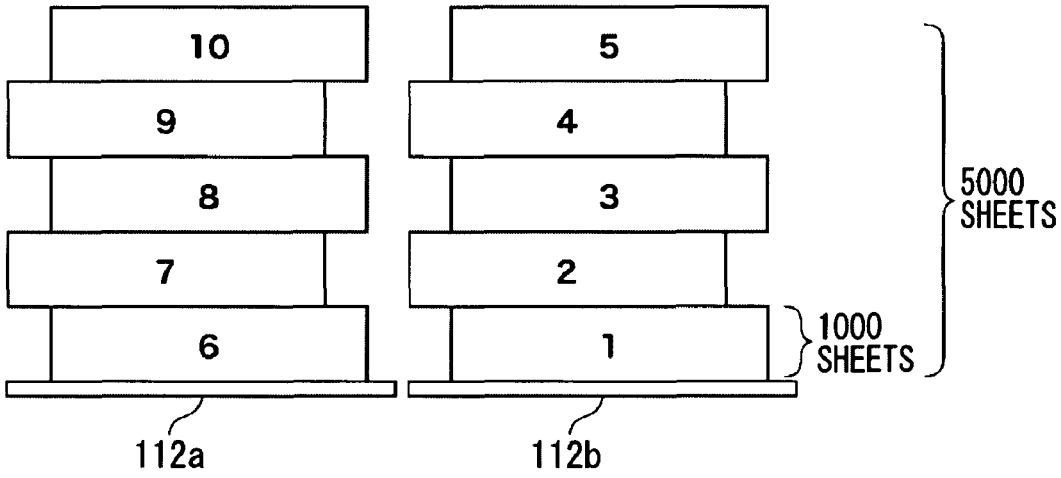
FIG. 20 illustrates how sheets are stacked on two stacker trays in a case where a job division mode is not set in a group mode according to an exemplary embodiment of the present invention.

FIG. 20 illustrates an example of how the sheets are stacked on the stacker trays 112*a* and 112*b* when the job division mode is not set in the group mode. FIG. 21 illustrates an example of how the sheets are stacked on the stacker trays 112*a* and 112*b* when the job division mode is set in the group mode.

For example, suppose that 1000 copies of a document (print data) which consists of 10 pages (numbered 1, 2, 3, 4, 5, 6, 7, 8, 9, and 10) are printed in the group mode. Further, suppose the upper limit on the stacking capacity of each stacker trays 112*a* and 112*b* is set at 5000 sheets.

Further, suppose a user selects "tray 2 priority" (which corresponds to stacker tray 112*b*) by pressing the key 705 on the second operation screen illustrated in FIG. 4. In the above-described examples with references to FIGS. 8 to 18 suppose that a user selects "tray 1 priority" (corresponding to stacker tray 112*a*) by pressing the key 705.

As illustrated in FIG. 20, if the job division mode is not set, 1000 copies of each of the first through fifth pages (1, 2, 3, 4, and 5) of the document are printed and sequentially stacked on the stacker tray 112*b*. As a result, 5000 sheets which is the upper limit on sheet stacking are stacked on the stacker tray 112*b*. Therefore, 1000 copies of each of the sixth through tenth pages (6, 7, 8, 9, and 10) of the document are then printed and sequentially stacked on the stacker tray 112*a*.

At this point, suppose that a user takes out the fully-stacked stacker tray 112*b* from the stacker apparatus 100 to perform a collation process on a bookbinding apparatus (not illustrated) while copies of sixth through tenth pages of the document are being stacked on the stacker tray 112*a*. In such a case, since the copies of sixth through tenth pages of the document are not stacked on the stacker tray 112*b*, the user cannot perform the collation process which follows the stacking process. Therefore, the user needs to wait for the copies of sixth through tenth pages of the document to be stacked on the stacker tray 112*a* which lowers productivity.

Figure 21:
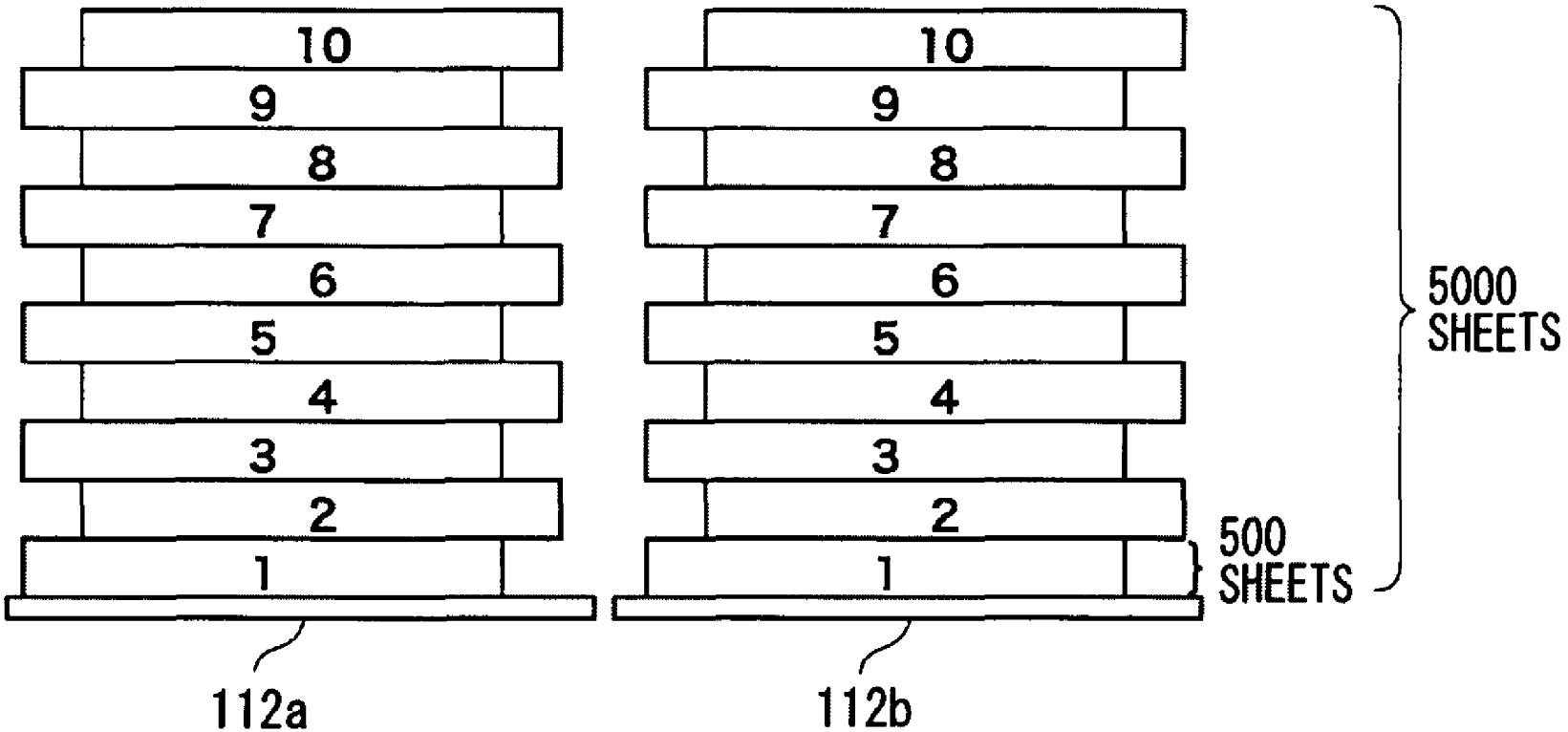
FIG. 21 illustrates how sheets are stacked on two stacker trays in a case where a job division mode is set in a group mode according to an exemplary embodiment of the present invention.
Figure 22:
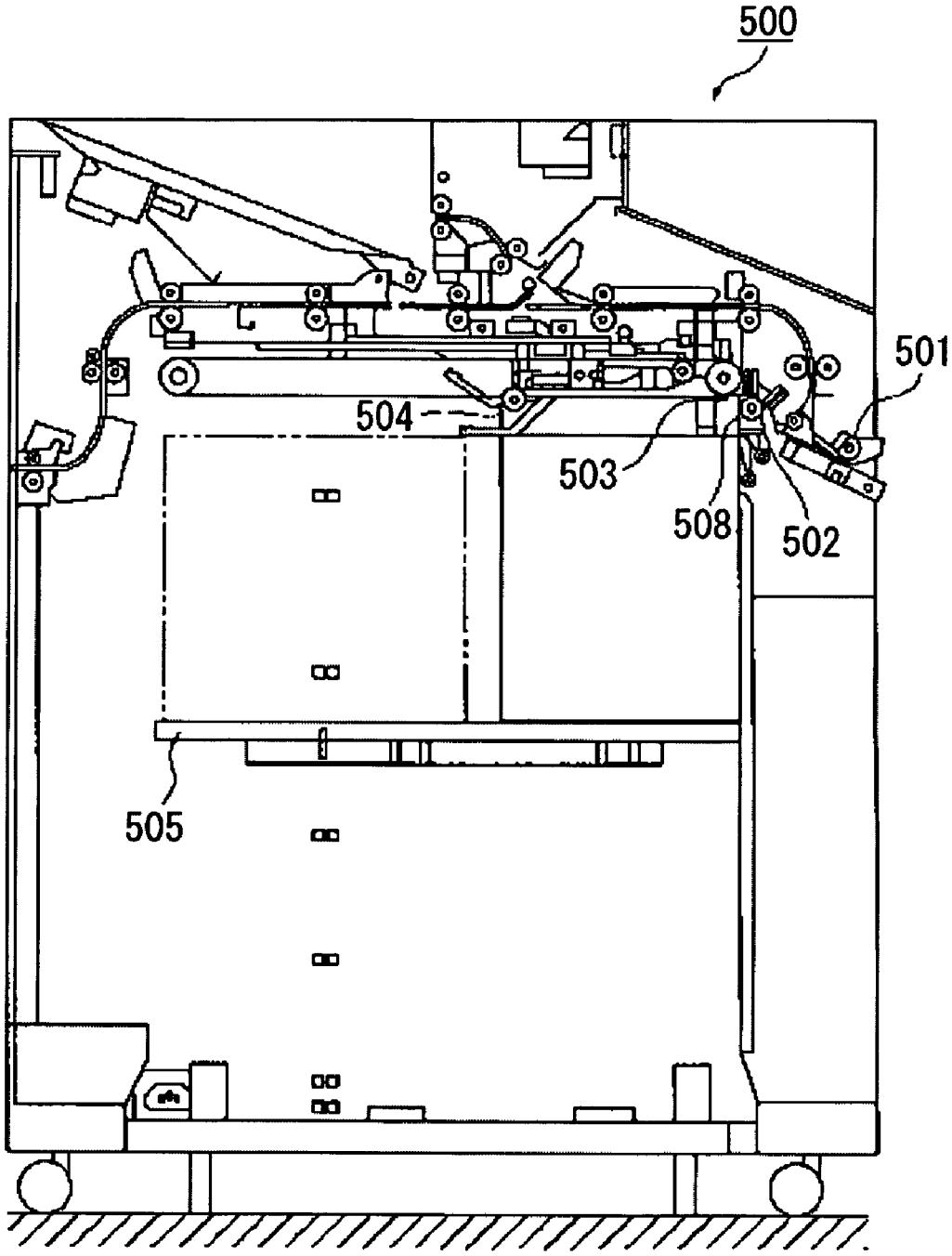
FIG. 22 illustrates a conventional stacker apparatus.
Figure 23:
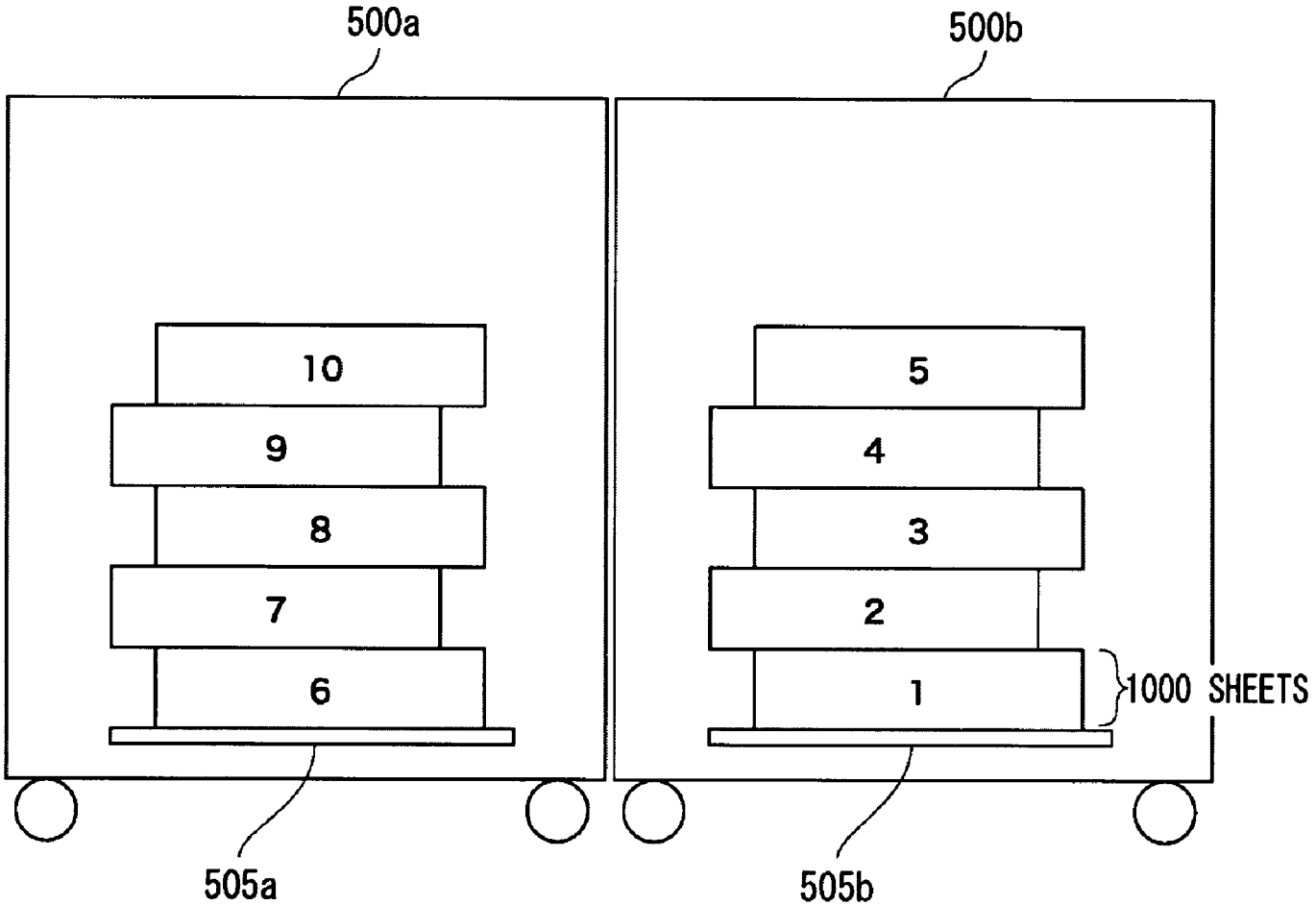
FIG. 23 illustrates two conventional stacker trays which are connected to each other.

However, if the job division mode is set, the order of stacking the sheets on the stacker trays 112*a* and 112*b* changes, as illustrated in FIG. 21. In particular, 500 copies of each of first through tenth pages (1, 2, 3, 4, 5, 6, 7, 8, 9, and 10) of the document are printed and sequentially stacked on the stacker tray 112*b*. As a result, 5000 sheets which equal the upper limit on the stacking capacity are stacked on the stacking tray 112*b*. The remaining 500 copies of each of the first through tenth pages (1, 2, 3, 4, 5, 6, 7, 8, 9, and 10) of the document are then printed and sequentially stacked on the stacker tray 112*a*.

As described above, in a case where the group mode is set in the print job which prints a total number of sheets that exceeds the upper limit on the stacking capacity of the stacker tray, the print job is divided into a plurality of print jobs (print operations). In particular, the print job is divided such that the number of printouts for one group (i.e., a number of printouts of the same original page) becomes less than the set number of copies. The stacking mode is thus changed so that printed copies of all pages of the document are stacked on one stacker tray. As a result, the fully-stacked stacker tray 112*b* can be taken out while the rest of the sheets are being stacked on the stacker tray 112*a*, and the step following the stacking process, such as a collation process, can be promptly started.

In the present exemplary embodiment, the stacker apparatus 100 includes two stacker trays 112*a* and 112*b*. However, a stacker apparatus can include three or more stacker trays. Further, the image forming apparatus 900 can be connected to a plurality of stacker apparatuses.

Moreover, in the present exemplary embodiment, the stacker control unit 210 is included in the stacker apparatus 100. However, the stacker control unit 210 can alternatively be included in the image forming apparatus 900 or elsewhere.

Further, the present invention can be realized using an auxiliary stacker tray in a case where the stacker apparatus 100 includes only one stacker tray. For example, 500 copies of each of the first through tenth pages of a document are printed and sequentially stacked on the stacker tray 112*b*. The stacker tray 112*b* on which 5000 sheets are stacked is transferred to an external bookbinding apparatus, and the auxiliary stacker tray is loaded on the stacker apparatus. The remaining 500 copies of each of first through tenth pages of the document are then printed and stacked on the auxiliary stacker tray. As a result, the process following the stacking process, such as a collation process, can be promptly started.

Further, in a system in which a print server receives a print job and sends the print job to a printer, the print server divides the job and sends a plurality of the divided print jobs to the printer to acquire the same result of the present invention as described above.

Other Exemplary Embodiments

The present invention can also be achieved by providing a storage medium which stores software (program code) for implementing functions of the above-described exemplary embodiments of the present invention to a system or an apparatus. The program code stored in the storage medium can be read and executed by a computer (central processing unit (CPU) or micro-processing unit (MPU)) of the system or the apparatus.

In this case, the software (program code) itself realizes the functions of the above-described exemplary embodiments. The software (program code) itself and the storage medium which stores the software (program code) constitute the present invention.

The storage medium can be, for example, a floppy disk, a hard disk, a magneto-optical disk, a compact disc-read-only memory (CD-ROM), a CD-recordable (CD-R), a CD-rewritable (CD-RW), a digital versatile disc (DVD) ROM, a DVD-RAM, DVD-RW, DVD+RW, a magnetic tape, a nonvolatile memory card, or a ROM. Further, such software (program code) can be downloaded via a network.

Furthermore, an operating system (OS) or the like working on a computer can also perform a part or whole of processes according to instructions of the software (program code) and realize functions of the above-described exemplary embodiments.

Furthermore, software (program code) read from a storage medium can be stored in a memory equipped in a function expansion board inserted in a computer or a function expansion unit connected to a computer, and a CPU in the function expansion board or the function expansion unit can execute a part or whole of the processing based on the instructions of the software (program code) to realize the functions of the above-described exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-122533 filed May 7, 2007, which is hereby incorporated by reference herein in its entirety.

What is claimed is:

1. An image forming apparatus for printing multiple copies of images, the images having N (where N is an integer equal to or larger than 2) pages, comprising:

an image forming unit configured to print images on a plurality of sheets according to an input print job;

a sheet stacking unit configured to stack sheets printed by the image forming unit, the sheet stacking unit including at least one sheet stacking tray;

a group mode determination unit configured to determine whether a group mode in which a plurality of sheets, on which an image of a same page is printed, are stacked as a sheet bundle, is set in the print job;

a number determination unit configured to determine whether a total number of sheets to be printed in the print job is larger than an upper limit on a stacking capacity of the at least one sheet stacking tray; and a control unit configured to divide a print job which prints M (where M is an integer) copies of each of the N pages of the images into a plurality of print operations in a case where the group mode determination unit determines that the group mode is set and the number determination unit determines that the total number of sheets to be printed in the print job is larger than the upper limit, wherein a first print operation of the plurality of print operations is to sequentially print sets of L (where L is an integer smaller than M) copies of each of the N pages of the images and to stack the N×L (N multiplied by L) printed sheets on the sheet stacking unit as a first print set, wherein the control unit divides the print job so that a second print set is stacked on the sheet stacking unit after the first print set is stacked on the sheet stacking unit.

2. The image forming apparatus according to claim 1, wherein the control unit divides the print job so that a number of sheets to be printed in each of the plurality of print operations is less than or equal to the upper limit on the stacking capacity.

3. The image forming apparatus according to claim 1, wherein the sheet stacking unit includes a plurality of sheet stacking trays, and the control unit divides the print job into the plurality of print operations in a case where the total number of sheets to be printed in the print job is greater than an upper limit on a stacking capacity of one sheet stacking tray.

4. The image forming apparatus according to claim 3, wherein the control unit controls the stacking unit so that sheets are stacked on a first sheet stacking tray in the first print operation and the sheets are stacked on a second sheet stacking tray in a second print operation subsequent to the first print operation.

5. An image forming apparatus for printing multiple copies of images, the images having N (where N is an integer equal to or larger than 2) pages, comprising:

an image forming unit configured to print images on a plurality of sheets according to an input print job;

a sheet stacking unit configured to stack sheets printed by the image forming unit, the sheet stacking unit including at least one sheet stacking tray;

a group mode determination unit configured to determine whether a group mode in which a plurality of sheets, on which an image of a same page is printed, are stacked as a sheet bundle, is set in the print job;

a number determination unit configured to determine whether a total number of sheets to be printed in the print job is larger than an upper limit on a stacking capacity of the at least one sheet stacking tray; and a control unit configured to control an order of printing in a print job which prints M (where M is an integer) copies of each of the N pages of the images so that sets of L (where L is an integer smaller than M) copies of each of the N pages of the images are sequentially printed and thereafter sets of M−L copies of each of the N pages of the images are printed, in a case the group mode determination unit determines that the group mode is set and the number determination unit determines that the total number of sheets to be printed in the print job is larger than the upper limit, wherein the sets of L copies of each of the *N pages are stacked on the at least one sheet stacking tray as one print set.

6. The image forming apparatus according to claim 5, wherein the control unit controls the order of printing in the print job so that sets of M copies of each of the N pages of the images are sequentially printed if the total number of sheets to be printed in the print job is less than or equal to the upper limit.

7. A method for controlling an image forming apparatus including an image forming unit configured to print images on a plurality of sheets according to an input print job and a sheet stacking unit, which includes at least one sheet stacking tray, configured to stack sheets printed by the image forming unit, the method comprising:

determining whether a group mode in which a plurality of sheets, on which an image of a same page is printed, are stacked as a sheet bundle, is set in a print job which prints M (where M is an integer) copies of each of the N (where N is an integer equal to or larger than 2) pages of the images;

determining whether a total number of sheets to be printed in the print job is larger than an upper limit on a stacking capacity of the at least one sheet stacking tray; and dividing the print job into a plurality of print operations in a case where the group mode is set and the total number of sheets to be printed is greater than the upper limit, wherein a first print operation of the plurality of print operations is to sequentially print sets of L (where L is an integer smaller than M) copies of each of the N pages of the images and to stack the N×L (N multiplied by L) printed sheets on the sheet stacking unit as a first print set, and wherein, in the dividing, the print job is divided so that a second print set is stacked on the sheet stacking unit in a second print operation after the first print set is stacked on the sheet stacking unit.

8. A method for controlling an image forming apparatus including an image forming unit configured to print images on a plurality of sheets according to an input print job and a sheet stacking unit, which includes at least one sheet stacking tray, configured to stack sheets printed by the image forming unit, the method comprising:

determining whether a group mode in which a plurality of sheets, on which an image of a same page is printed, are stacked as a sheet bundle, is set in a print job which prints M (where M is an integer) copies of each of N (where N is an integer equal to or larger than 2) pages of the images;

determining whether a total number of sheets to be printed in the print job is larger than an upper limit on a stacking capacity of the at least one sheet stacking tray; and controlling an order of printing in the print job so that sets of L (where L is an integer smaller than M) copies of each of the N pages of the images are sequentially printed and thereafter sets of M−L copies of each of the N pages of the images are printed in a case where a group mode is set and the total number of sheets to be printed in the print job is greater than the upper limit, wherein the sets of L copies of each of the *N pages are stacked on the at least one sheet stacking tray of the sheet stacking unit as one print set.

9. The method according to claim 8, further comprising:

controlling the order of printing in the print job so that sets of M copies of each of the N pages of the images are sequentially printed in a case where the total number of sheets to be printed is less than or equal to the upper limit.

10. An image forming apparatus for printing multiple copies of images, the images having N (where N is an integer equal to or larger than 2) pages, comprising:

an image forming unit configured to print images on a plurality of sheets according to an input print job;

a sheet stacking unit configured to stack sheets printed by the image forming unit, the sheet stacking unit including first and second trays to stack sheets;

a group mode determination unit configured to determine whether a group mode in which a plurality of sheets, on which an image of a same page is printed, are stacked as a sheet bundle, is set in the print job;

a number determination unit configured to determine whether a total number of sheets to be printed in the print job is larger than an upper limit on a stacking capacity of the first tray; and a control unit configured to divide a print job which prints M (where M is an integer) copies of each of the N pages of the images into a plurality of print operations in a case where the group mode determination unit determines that the group mode is set and the number determination unit determines that the total number of sheets to be printed in the print job is larger than the upper limit, wherein a first print operation of the plurality of print operations is to sequentially print sets of L (where L is an integer smaller than M) copies of each of the N pages of the images and to stack the N×L (N multiplied by L) printed sheets on the sheet stacking unit as a first print set, wherein the control unit divides the print job so that a second print set of sheets is stacked on the second tray in a second print operation after the first print set of sheets is stacked on the first tray.

* * * * *